US010759029B2

(12) United States Patent
Schnell et al.

(10) Patent No.: US 10,759,029 B2
(45) Date of Patent: Sep. 1, 2020

(54) POWERED FASTENER DRIVER AND OPERATING METHOD THEREOF

(71) Applicant: TECHTRONIC POWER TOOLS TECHNOLOGY LIMITED, Tortola (VG)

(72) Inventors: John Schnell, Anderson, SC (US); Edward A. Pomeroy, Piedmont, SC (US); Essam Namouz, Greenville, SC (US); Henry Johnson, Seneca, SC (US); Jie Liu, Dongguan (CN); Hailing Lin, Dongguan (CN); Jinlin Zhou, Dongguan (CN); Xinghong Li, Dongguan (CN); Ziqiang Cao, Dongguan (CN); Liguo Ma, Dongguan (CN)

(73) Assignee: TECHTRONIC POWER TOOLS TECHNOLOGY LIMITED, Tortola (VG)

( * ) Notice: Subject to any disclaimer, the term of this patent is extended or adjusted under 35 U.S.C. 154(b) by 803 days.

(21) Appl. No.: 15/265,981

(22) Filed: Sep. 15, 2016

(65) Prior Publication Data

US 2017/0001291 A1 Jan. 5, 2017

Related U.S. Application Data

(63) Continuation of application No. PCT/CN2014/077551, filed on May 15, 2014.
(Continued)

(51) Int. Cl.

| | |
|---|---|
| ***B25C 1/04*** | (2006.01) |
| ***B25C 1/00*** | (2006.01) |
| ***B25C 1/06*** | (2006.01) |

(52) U.S. Cl.
CPC ..... *B25C 1/04* (2013.01); *B25C 1/00* (2013.01); *B25C 1/044* (2013.01); *B25C 1/06* (2013.01)

(58) Field of Classification Search
CPC .. B25C 1/00; B25C 1/044; B25C 1/06; B25C 5/15
See application file for complete search history.

(56) References Cited

U.S. PATENT DOCUMENTS 3,567,098 A 3/1971 Maynard
3,809,307 A 5/1974 Wandel et al.
(Continued)

FOREIGN PATENT DOCUMENTS

CA 2465400 5/2003
CN 85106683 3/1987
(Continued)

OTHER PUBLICATIONS

International Search Report and Written Opinion for Application No. PCT/CN2014/077551 dated Dec. 1, 2014 (14 pages).

*Primary Examiner* — Chelsea E Stinson
(74) *Attorney, Agent, or Firm* — Michael Best & Friedrich LLP

(57) ABSTRACT

A powered fastener driver includes a cylinder and a drive piston within the cylinder being acted on by a driving force resulting from a pressure differential. The powered fastener further includes a drive blade coupled to the drive piston and operable to drive a fastener, and an adjustable valve for selectively introducing air from ambient atmosphere into the cylinder, thereby changing the pressure differential acting on the drive piston. By adopting a self-contained vacuum generating means as described above, the present invention does not rely on any external vacuum source and powered fastener driver can be used and carried with conveniently.

18 Claims, 27 Drawing Sheets

Related U.S. Application Data

(60) Provisional application No. 61/970,963, filed on Mar. 27, 2014.

(56) References Cited

U.S. PATENT DOCUMENTS

| | | | |
|---|---|---|---|
| 3,835,935 | A | 9/1974 | Sides et al. |
| 4,222,443 | A | 9/1980 | Chromy |
| 4,251,017 | A | 2/1981 | Doyle et al. |
| 4,630,766 | A | 12/1986 | Steeves et al. |
| 4,657,166 | A | 4/1987 | Anstett |
| 4,667,572 | A | 5/1987 | Elliesen |
| 4,706,867 | A | 11/1987 | Anstett |
| 4,823,886 | A | 4/1989 | Pyatov |
| 4,828,046 | A | 5/1989 | Pyatov |
| 4,856,696 | A | 8/1989 | Seld |
| 4,907,730 | A | 3/1990 | Dion |
| 4,932,479 | A | 6/1990 | Pyatov |
| 4,932,480 | A | 6/1990 | Golsch |
| 5,092,410 | A | 3/1992 | Wallace et al. |
| 5,199,627 | A | 4/1993 | Christensen |
| 5,356,063 | A | 10/1994 | Perez |
| 5,495,973 | A | 3/1996 | Ishizawa et al. |
| 5,579,975 | A | 12/1996 | Moorman |
| 5,683,024 | A | 11/1997 | Eminger et al. |
| 5,706,996 | A | 1/1998 | Lee |
| 5,803,338 | A | 9/1998 | Singer et al. |
| 5,878,936 | A | 3/1999 | Adachi et al. |
| 5,909,836 | A | 6/1999 | Shkolnikov et al. |
| 6,039,231 | A | 3/2000 | White |
| 6,145,724 | A | 11/2000 | Shkolnikov et al. |
| 6,145,727 | A | 11/2000 | Mukoyama et al. |
| 6,422,447 | B1 | 7/2002 | White et al. |
| 6,431,430 | B1 | 8/2002 | Jalbert et al. |
| 6,445,636 | B1 | 9/2002 | Keeth et al. |
| 6,488,195 | B2 | 12/2002 | White et al. |
| 6,499,643 | B1 | 12/2002 | Hewitt |
| 6,519,962 | B1 | 2/2003 | Schuetter |
| 6,523,622 | B1 | 2/2003 | Berger et al. |
| 6,607,111 | B2 | 8/2003 | Garvis et al. |
| 6,619,407 | B1 | 9/2003 | Hawkins et al. |
| 6,622,802 | B2 | 9/2003 | Hezeltine |
| 6,669,072 | B2 | 12/2003 | Burke et al. |
| 6,672,498 | B2 | 1/2004 | White et al. |
| 6,755,336 | B2 | 6/2004 | Harper et al. |
| 6,796,475 | B2 | 9/2004 | Adams |
| 6,845,896 | B2 | 1/2005 | Kral |
| 6,857,548 | B1 | 2/2005 | Clark |
| 6,938,704 | B2 | 9/2005 | Berger et al. |
| 6,974,061 | B2 | 12/2005 | Adams et al. |
| 7,048,073 | B2 | 5/2006 | Hezeltine |
| 7,048,168 | B2 | 5/2006 | Wargel |
| 7,137,540 | B2 | 11/2006 | Terrell et al. |
| 7,278,561 | B2 | 10/2007 | Schnell et al. |
| 7,306,049 | B2 | 12/2007 | Soika et al. |
| 7,308,995 | B2 | 12/2007 | Uchiyama et al. |
| 7,316,341 | B2 | 1/2008 | Schnell et al. |
| 7,331,408 | B2 | 2/2008 | Arich et al. |
| 7,387,227 | B1 | 6/2008 | Jiang et al. |
| 7,407,070 | B2 | 8/2008 | Hezeltine |
| 7,458,492 | B2 | 12/2008 | Terrell et al. |
| 7,464,635 | B2 | 12/2008 | Rantala et al. |
| 7,484,649 | B2 | 2/2009 | Schnell et al. |
| 7,503,473 | B2 | 3/2009 | Niblett et al. |
| 7,588,096 | B2 | 9/2009 | Panasik |
| 7,705,497 | B2 | 4/2010 | Arich et al. |
| 7,726,414 | B2 | 6/2010 | Berger et al. |
| 8,011,441 | B2 | 9/2011 | Leimbach et al. |
| 8,011,547 | B2 | 9/2011 | Leimbach et al. |
| RE43,041 | E | 12/2011 | Adams et al. |
| 8,079,504 | B1 | 12/2011 | Pedicini et al. |
| 8,122,972 | B2 | 2/2012 | Soika et al. |
| 8,230,941 | B2 | 7/2012 | Leimbach et al. |
| 8,267,296 | B2 | 9/2012 | Leimbach et al. |
| 8,267,297 | B2 | 9/2012 | Leimbach et al. |
| 8,276,798 | B2 | 10/2012 | Moeller et al. |
| 8,286,722 | B2 | 10/2012 | Leimbach et al. |
| 8,286,725 | B2 | 10/2012 | Arich |
| 8,302,832 | B2 | 11/2012 | Porth et al. |
| 8,360,098 | B2 | 1/2013 | Chuang et al. |
| 8,387,718 | B2 | 3/2013 | Leimbach et al. |
| 8,393,512 | B2 | 3/2013 | Tanimoto et al. |
| 8,430,182 | B2 | 4/2013 | Soika et al. |
| 8,579,173 | B2 | 11/2013 | Gustasson et al. |
| 8,733,610 | B2 | 5/2014 | Pedicini |
| 8,931,678 | B2 | 1/2015 | Liu |
| 8,939,229 | B2 | 1/2015 | Hartmann et al. |
| 9,010,457 | B2 | 4/2015 | Kamegai et al. |
| 9,486,904 | B2 | 11/2016 | Gregory et al. |
| 9,555,530 | B2 * | 1/2017 | Pedicini ..... B25C 1/06 |
| 9,643,305 | B2 | 5/2017 | Gregory et al. |
| 9,662,777 | B2 * | 5/2017 | Pomeroy ..... B25C 1/041 |
| 2002/0017548 | A1 | 2/2002 | Jalbert et al. |
| 2002/0104869 | A1 | 8/2002 | Garvis et al. |
| 2002/0108474 | A1 | 8/2002 | Adams |
| 2002/0108993 | A1 | 8/2002 | Harper et al. |
| 2002/0108994 | A1 | 8/2002 | Burke et al. |
| 2002/0139546 | A1 | 10/2002 | Hezeltine |
| 2002/0185514 | A1 | 12/2002 | Adams et al. |
| 2003/0000990 | A1 | 1/2003 | White et al. |
| 2003/0173393 | A1 | 9/2003 | Kral |
| 2004/0035902 | A1 | 2/2004 | Hezeltine |
| 2004/0045728 | A1 | 3/2004 | Hezeltine |
| 2004/0065455 | A1 | 4/2004 | Berger et al. |
| 2004/0251038 | A1 | 12/2004 | Rantala et al. |
| 2005/0040206 | A1 | 2/2005 | Adams et al. |
| 2005/0066501 | A1 | 3/2005 | Wargel |
| 2005/0184120 | A1 | 8/2005 | Terrell et al. |
| 2005/0189392 | A1 | 9/2005 | Schnell et al. |
| 2005/0189393 | A1 | 9/2005 | Schnell et al. |
| 2006/0124333 | A1 | 6/2006 | Berger |
| 2006/0137888 | A1 | 6/2006 | Soika et al. |
| 2006/0144602 | A1 | 7/2006 | Arich et al. |
| 2006/0144603 | A1 | 7/2006 | Arich et al. |
| 2006/0144604 | A1 | 7/2006 | Soika et al. |
| 2006/0156858 | A1 | 7/2006 | Soika et al. |
| 2006/0156859 | A1 | 7/2006 | Nemetz |
| 2006/0156860 | A1 | 7/2006 | Arich |
| 2006/0159577 | A1 | 7/2006 | Soika et al. |
| 2006/0175068 | A1 | 8/2006 | Hezeltine |
| 2006/0261121 | A1 | 11/2006 | Uchiyama et al. |
| 2007/0034660 | A1 | 2/2007 | Terrell et al. |
| 2007/0257079 | A1 | 11/2007 | Schnell et al. |
| 2008/0073096 | A1 | 3/2008 | Berger et al. |
| 2008/0197166 | A1 | 8/2008 | Schnell et al. |
| 2009/0178819 | A1 | 7/2009 | Schnell et al. |
| 2009/0277659 | A1 | 11/2009 | Roelfs et al. |
| 2010/0072248 | A1 | 3/2010 | Lai et al. |
| 2010/0263737 | A1 | 10/2010 | Chuang et al. |
| 2010/0276170 | A1 | 11/2010 | Lee |
| 2011/0174858 | A1 | 7/2011 | Yang et al. |
| 2011/0198381 | A1 | 8/2011 | McCardle et al. |
| 2011/0303430 | A1 | 12/2011 | Hartmann et al. |
| 2012/0061445 | A1 | 3/2012 | Liu |
| 2012/0080208 | A1 | 4/2012 | Lin et al. |
| 2012/0118932 | A1 | 5/2012 | Largo et al. |
| 2012/0137875 | A1 | 6/2012 | Lin et al. |
| 2012/0160889 | A1 | 6/2012 | Tanji |
| 2012/0234571 | A1 | 9/2012 | Kamegai et al. |
| 2012/0286014 | A1 * | 11/2012 | Pedicini ..... B25C 1/04 227/4 |
| 2013/0037593 | A1 | 2/2013 | Porth et al. |
| 2013/0134204 | A1 | 5/2013 | Morioka et al. |
| 2014/0014703 | A1 | 1/2014 | Kestner et al. |
| 2014/0054350 | A1 * | 2/2014 | Pedicini ..... B25C 5/15 227/8 |
| 2014/0144658 | A1 | 5/2014 | Schmid et al. |
| 2015/0053736 | A1 * | 2/2015 | Pomeroy ..... B25C 1/041 227/142 |

(56) References Cited

U.S. PATENT DOCUMENTS

| | | | |
|---|---|---|---|
| 2017/0001291 | A1 | 1/2017 | Schnell et al. |
| 2018/0154505 | A1 | 6/2018 | Sato et al. |

FOREIGN PATENT DOCUMENTS

| | | |
|---|---|---|
| CN | 2150022 | 12/1993 |
| CN | 2868587 | 2/2007 |
| CN | 101903134 | 12/2010 |
| EP | 0489229 | 6/1992 |
| WO | 0214027 | 2/2002 |
| WO | 03039814 | 5/2003 |
| WO | 2012061295 | 5/2012 |

* cited by examiner

POWERED FASTENER DRIVER AND OPERATING METHOD THEREOF

CROSS-REFERENCE TO RELATED APPLICATIONS

This application is a continuation of International Patent Application No. PCT/CN2014/077551, filed on May 15, 2014, which claims priority to U.S. Provisional Patent Application No. 61/970,963, filed on Mar. 27, 2014, the entire contents of both are incorporated herein by reference.

FIELD OF THE INVENTION

The present invention relates to power tools, and more specifically to powered fastener drivers.

BACKGROUND OF THE INVENTION

There are various fastener drivers known in the art for driving fasteners (e.g., nails, tacks, staples, etc.) into a workpiece. These fastener drivers operate utilizing various means known in the art (e.g., compressed air generated by an air compressor, electrical energy, flywheel mechanisms), but often these designs are met with power, size, and cost constraints.

SUMMARY OF THE INVENTION

The invention provides, in one aspect, a powered fastener driver including a cylinder and a drive piston within the cylinder being acted on by a driving force resulting from a pressure differential. The powered fastener further includes a drive blade coupled to the drive piston and operable to drive a fastener, and an adjustable valve for selectively introducing air from ambient atmosphere into the cylinder, thereby changing the pressure differential acting on the drive piston.

Changing the pressure differential acting on the drive piston may change a driving depth of the fastener.

A larger pressure differential acting on the drive piston may increase the driving depth of the fastener.

The adjustable valve may include a lever that is movable to adjust the amount of air from ambient atmosphere introduced into the cylinder.

The lever may be rotatable to adjust the amount of air from ambient atmosphere introduced into the cylinder.

The adjustable valve may include an end cap secured to one end of the cylinder, wherein the end cap has an aperture therein, and a shutter movable to block at least a portion of the aperture.

The shutter may be movable between a first position in which the aperture is substantially unblocked and a second position in which the aperture is substantially blocked. The pressure differential acting on the drive piston when the shutter is in the first position is greater than when the shutter is in the second position.

The adjustable valve may include a lever that is manipulatable by a user of the fastener driver and that is coupled for co-rotation with the shutter.

The adjustable valve may be located above the drive piston in a top portion of the cylinder.

A screen may be positioned between the adjustable valve and the atmosphere.

The pressure differential acting on the drive piston may be defined in part by a vacuum created within the cylinder.

The powered fastener driver may include a reciprocating piston within the cylinder for creating the vacuum.

The invention provides, in another aspect, a powered fastener driver including a cylinder, a reciprocating piston within the cylinder, and a drive blade. The powered fastener driver further includes a latch holding the drive blade in position while being acted on by a driving force, and a trip member carried by the reciprocating piston for disengaging the latch from the drive blade, thereby allowing the drive blade to move under the influence of the driving force.

The powered fastener may further include a drive piston coupled to the drive blade.

The driving force may result from a pressure differential acting on the drive piston.

The pressure differential may be created by a vacuum developed between the drive piston and the reciprocating piston.

The vacuum may be developed by moving the reciprocating piston away from the drive piston.

The reciprocating piston may include a first side facing the drive piston and a second side opposite the first side. The trip member may be coupled to the second side.

The drive blade may include a notch.

The latch may include a pin that is receiveable in the notch.

The powered fastener driver may include a spring biasing the latch towards the drive blade.

The pressure differential may increase as the reciprocating piston approaches the latch.

The invention provides, in another aspect, a powered fastener driver including a cylinder, a reciprocating piston within the cylinder, and a leak path at least partially defined by the piston that selectively fluidly communicates portions of the cylinder adjacent, respectively, opposite sides of the piston. The powered fastener driver further includes a seal carried by the piston. The seal is movable relative to the piston between a first position in which the seal is engaged with the piston for blocking the leak path, and a second position in which the seal is disengaged from the piston for unblocking the leak path.

The powered fastener driver may include a drive piston having a drive blade that passes through the reciprocating piston.

The seal, when in the first position, may seal a space within the cylinder between the drive piston and the reciprocating piston.

The seal, when in the second position, may unseal the space within the cylinder between the drive piston and the reciprocating piston.

The reciprocating piston may include a recess in which the seal is received when in the first position.

The reciprocating piston may include a bracket that supports the seal when in the second position.

The seal may be moved between the first position and the second position by frictional contact between the seal and the drive blade.

The drive blade may pass through an aperture in the seal.

The seal may include a rib extending into a groove formed in the drive blade.

The leak path may be at least partially defined by the recess when the seal is in the second position.

The powered fastener driver may include a first lip seal coupled to a circumference of the reciprocating piston and extending radially outward to contact the cylinder.

The powered fastener driver may include a second lip seal coupled to a circumference of the drive piston and extending radially outward to contact the cylinder.

The powered fastener driver may include a rack coupled to the reciprocating piston.

The seal, when in the first position, may seal a space within the cylinder between the drive piston and the reciprocating piston.

The seal, when in the second position, may unseal the space within the cylinder between the drive piston and the reciprocating piston.

The reciprocating piston may include a recess in which the seal is received when in the first position.

The powered fastener driver may include a fastener connecting the rack to the reciprocating piston. The seal may be disposed around a shank of the fastener.

The seal may be moved between the first position and the second position in response to displacement of the rack relative to the reciprocating piston.

The seal may be an O-ring.

The leak path may be at least partially defined by the recess when the seal is in the second position.

The invention provides, in another aspect, a method of operating a powered fastener driver having a cylinder, a drive piston within the cylinder having a drive blade, and a reciprocating piston within the cylinder through which the drive blade is extendable. The method includes maintaining the drive piston within the cylinder at a top dead center position, and moving the reciprocating piston away from the drive piston at a first speed while the drive piston is maintained at the top dead center position. The method further includes detecting the reciprocating piston with a monitoring system prior to the reciprocating piston reaching a bottom dead center position within the cylinder, and decelerating the reciprocating piston from the first speed in response to being detected.

The method may include releasing the drive piston from the top dead center position once the reciprocating piston reaches the bottom dead center position.

The method may include moving the reciprocating piston toward the drive piston at a second speed once the drive piston has been released from the top dead center position.

The method may include detecting the drive piston with the monitoring system prior to the drive piston reaching the top dead center position, and decelerating the reciprocating piston from the second speed in response to being detected.

The method may include detecting the reciprocating piston with the monitoring system prior to the reciprocating piston reaching the top dead center position, and continuing to move the reciprocating piston toward the drive piston for a predetermined period of time.

The method may include detecting abnormal operation with the monitoring system.

The method may include moving the reciprocating piston toward the drive piston in response to detecting abnormal operation.

In another aspect of the present invention, a powered fastener driver includes a cylinder; a reciprocating piston within the cylinder; a driving module connected to the reciprocating piston to drive the same for moving within the cylinder; a user actuating device connected to the driving module to control activation of the driving module; a magazine adapted to store a plurality of fasteners; and a lock out mechanism connected to the magazine. The lock out mechanism further contains a lock member movable between a first position in which the lock member unlocks the user actuating device to operate and a second position in which the lock member locks the user actuating device from operation.

The lock out mechanism may include a fastener push mechanism adapted to urge the lock member to move from the first position to the second position.

The fastener push mechanism may urge the lock member to move from the first position to the second position when the fasteners in the magazine are depleted.

The lock member may be rotatable around a hinge; the fastener push mechanism adapted to urge the lock member to rotate from the first position to the second position.

The powered fastener driver may also include a contact member. When the lock member is at the first position, the contact member separated from the lock member; when the lock member is at the second position, the contract member engaging and locked by the lock member.

In another aspect of the present invention, a powered fastener driver contains a cylinder; a reciprocating piston within the cylinder; a motor for providing driving power; a driving module connected to the motor and the reciprocating piston such that the driving power is provided to the reciprocating piston for moving within the cylinder; wherein the driving module further comprising a rotary member, and a clutch mechanism between the motor and the rotary member; the rotary member connecting to the reciprocating piston; the clutch mechanism adapted to selectively engage the motor with the reciprocating piston.

The rotary member may be a ring gear. The clutch mechanism may further include at least length-variable clutching element that can be configured to change between at least a first length and a second length.

The clutching element may include a spring. Oone end of the spring is connected to one of the rotary member and the motor. The other end of the spring connected to a detent member which in turn connects to the other one of the rotary member and the motor.

The first length may be an uncompressed length of the spring, and the second length may be the minimum length of the spring after compression.

The detent member may be a detent ball. The other one of the rotary member and the motor facing the detent ball has a surface on which there is formed two or more protrusions. Between two the protrusions there is formed a groove. When the clutching element is at the first length, rotation of the ring gear causes the detent ball to move along the groove and bypass the protrusions, so that the motor is not driven by the rotation of the ring gear. When the clutching element is at the second length, rotation of the motor causes the detent ball to be confined in the groove and not capable of bypassing the protrusions, so that the ring gear is driven to rotate by the motor.

Other aspects of the invention will become apparent by consideration of the detailed description and accompanying drawings.

DETAILED DESCRIPTION

Figure 1:
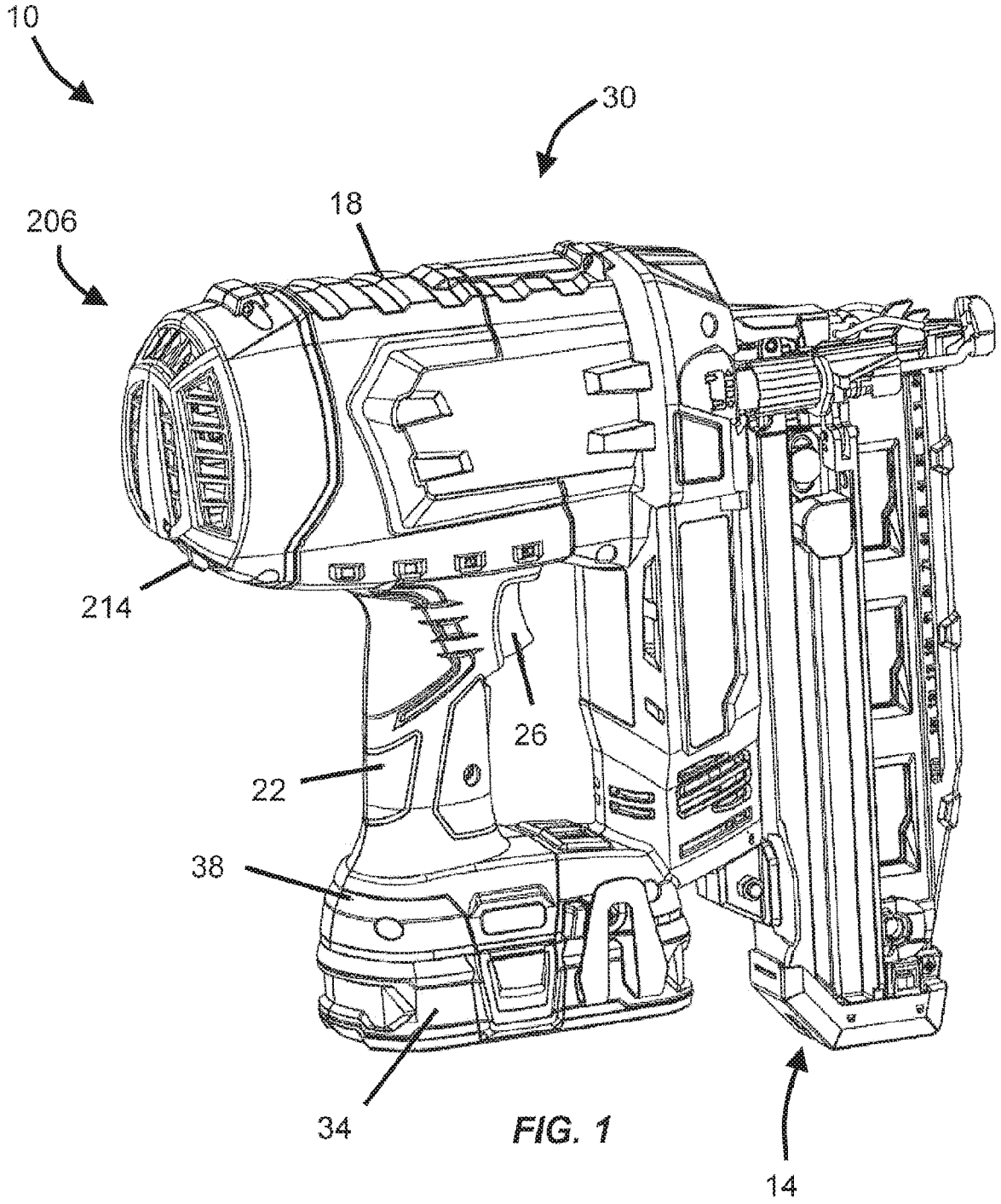
FIG. 1 is a perspective view of a powered fastener driver in accordance with an embodiment of the invention.
Figure 2:
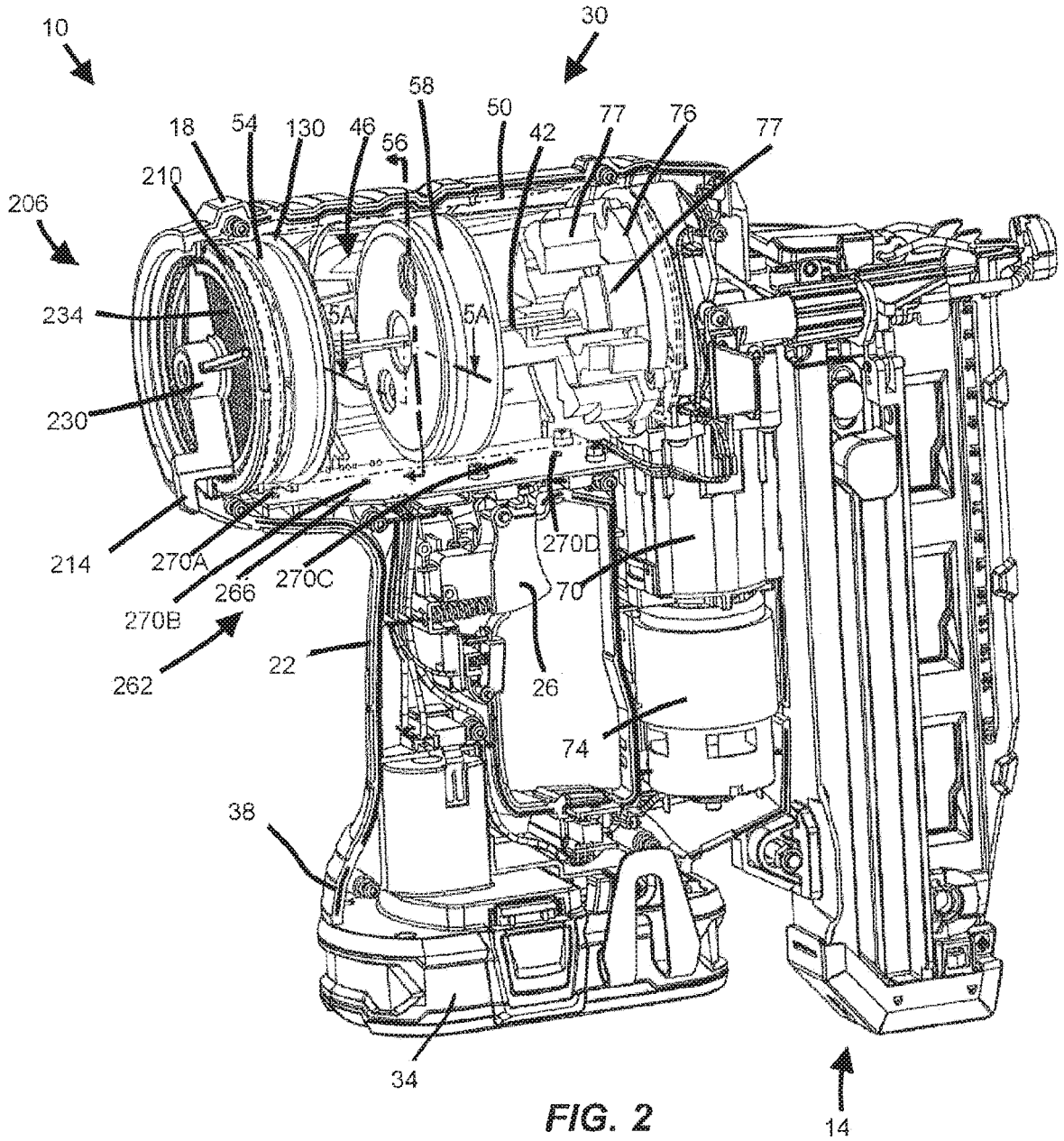
FIG. 2 is a partial cutaway view of the powered fastener driver of FIG. 1 with a cylinder shown in phantom.

FIG. 1 illustrates a vacuum powered fastener driver 10 operable to drive fasteners (e.g., nails, tacks, staples, etc.) held within a magazine 14 into a workpiece. The fastener driver 10 includes an outer housing 18 with a handle portion 22, and a user-actuated trigger 26 mounted on the handle portion 22. The fastener driver 10 does not require an external source of air pressure, but rather includes an on-board vacuum system 30 (FIG. 2). The vacuum system 30 is powered by a power source (e.g., a battery pack 34), coupled to a battery attachment portion 38 of the outer housing 18. In alternative embodiments, alternative power sources (i.e., an electrical cord) may provide power to the vacuum system 30.

Figure 3:
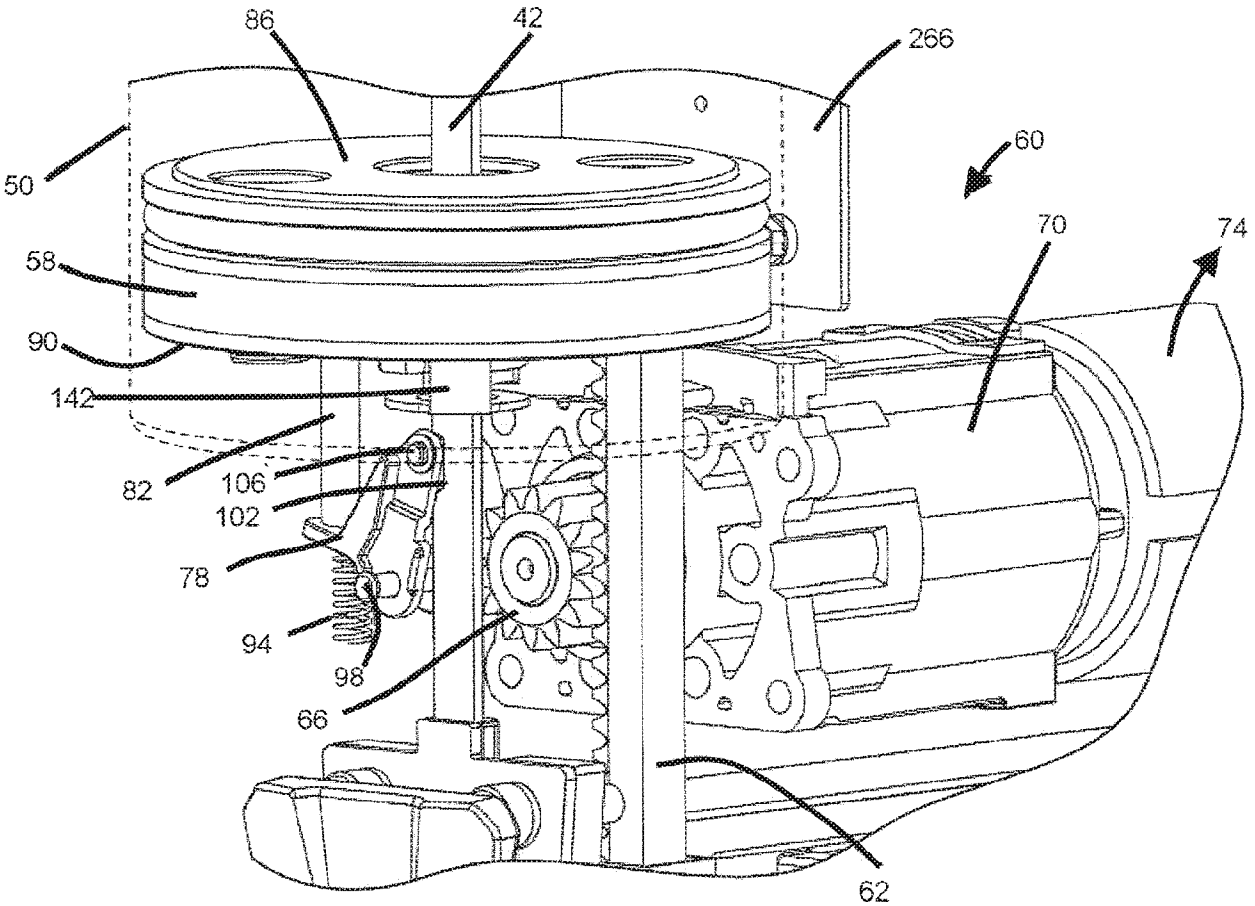
FIG. 3 is a perspective view of a drive assembly of the powered fastener driver of FIG. 1.

With reference to FIGS. 2 and 3, the fastener driver 10 includes a drive blade 42 actuated by the vacuum system 30 to drive the fasteners into a workpiece. The vacuum system 30 includes a variable-volume vacuum chamber 46 defined within a cylinder 50, between a drive piston 54 and an elevator or a reciprocating piston 58 (FIG. 2). The drive blade 42 is coupled to the drive piston 54, and the vacuum chamber 46 creates a driving force as a result of differential pressure acting on the drive piston 54. The reciprocating piston 58 is driven in a reciprocating manner by a drive assembly 60 (FIG. 3). In the illustrated embodiment of the fastener driver 10, the drive assembly 60 includes a motor 74, a transmission 70 that receives torque from the motor, a pinion 66 drivably coupled to the output of the transmission 70, and a rack 62 meshed with the pinion 66 and connected to the drive piston 54 for reciprocation therewith. With reference to FIG. 2, a vacuum is developed within the vacuum chamber 46 by moving the reciprocating piston 58 away from the drive piston 54, while the position of the drive piston 54 is held or maintained. A bumper 76 is positioned in a bottom portion of the cylinder 50 and absorbs impact forces from the reciprocating piston 58 and drive piston 54. The bumper 76 includes projections 77 that are received in corresponding recesses (not shown) formed in the reciprocating piston 58.

Figure 4A:
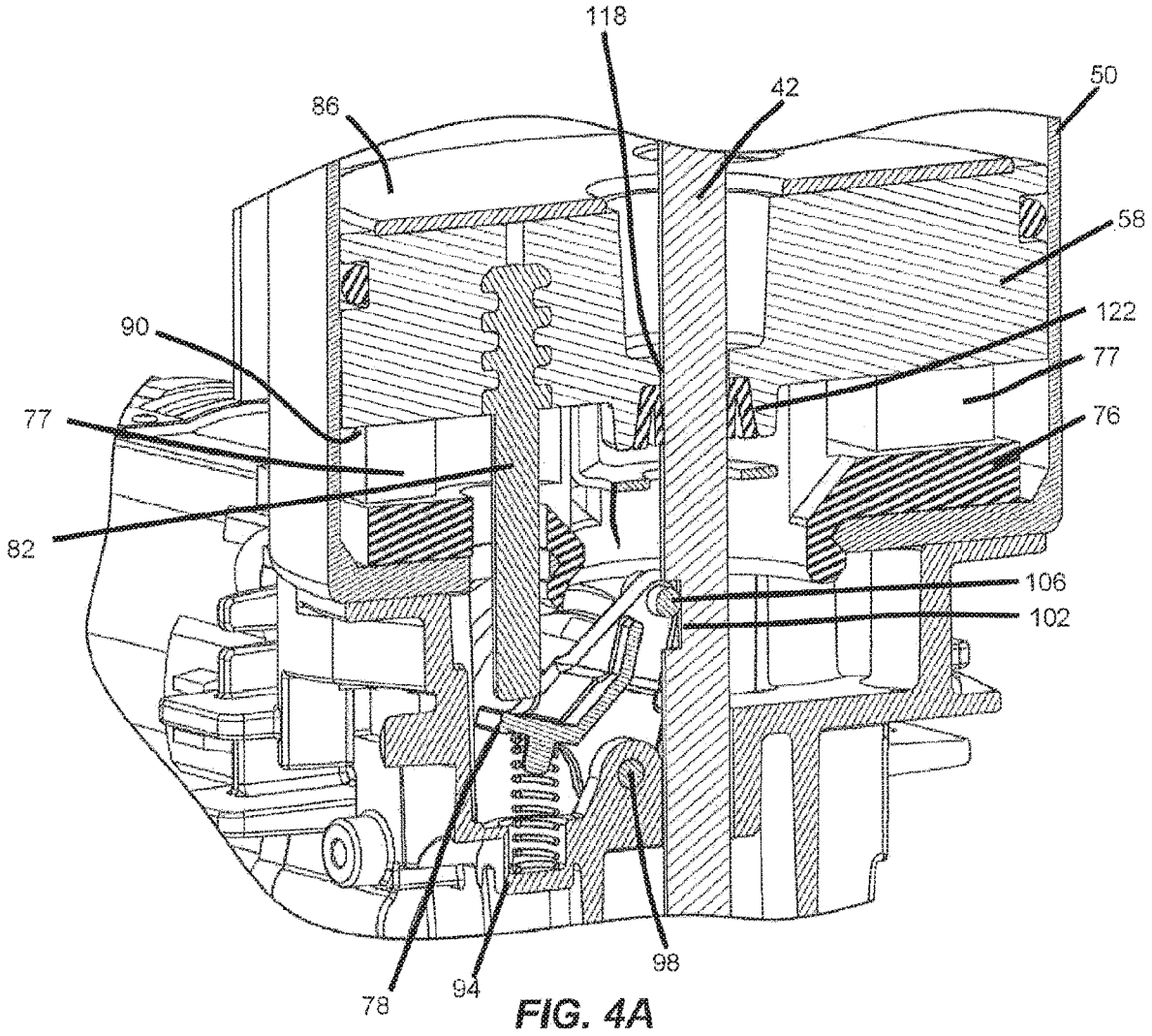
FIG. 4A is a cross-sectional view of a latch in a first, engaged position of the power fastener driver of FIG. 1.
Figure 4B:
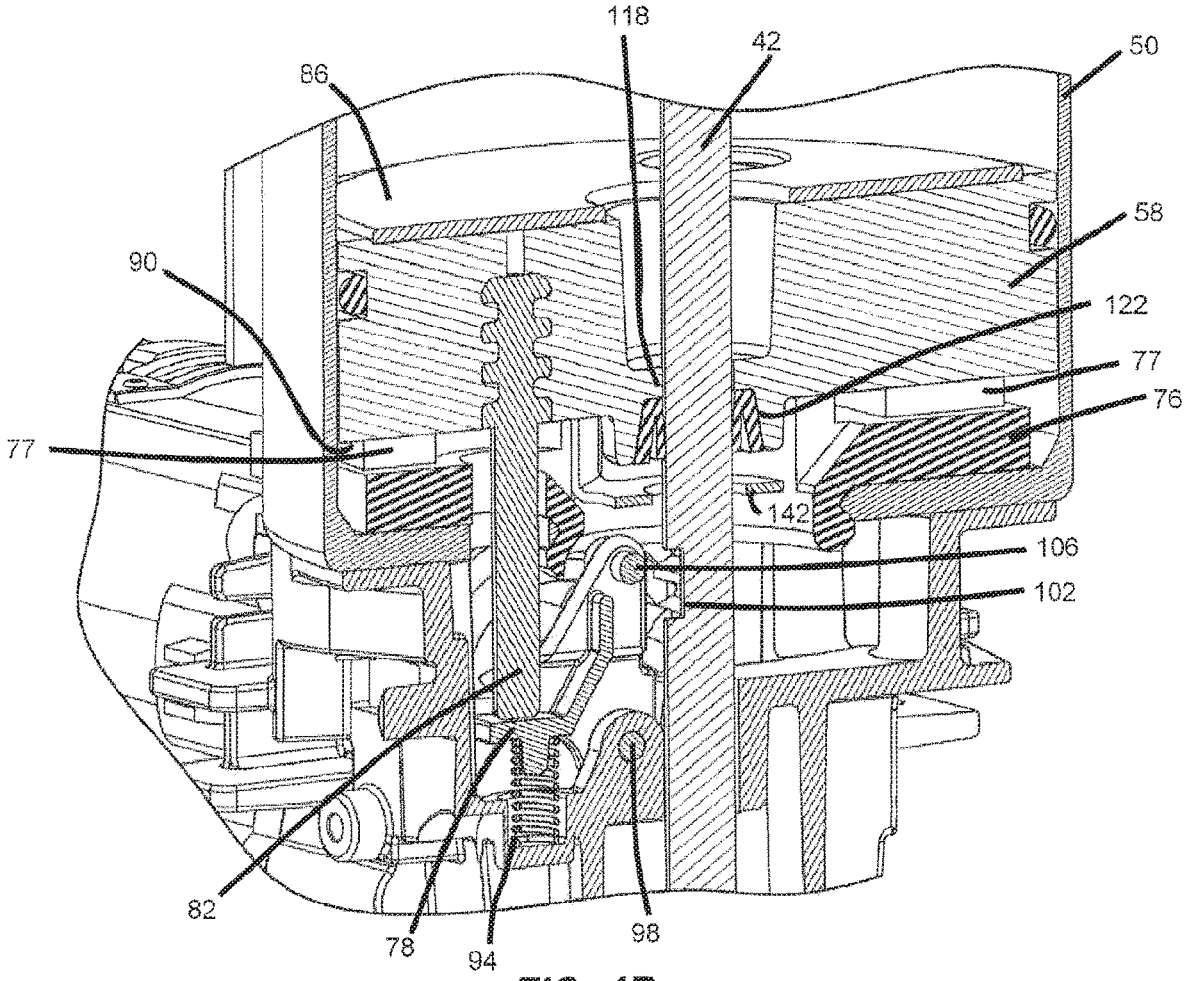
FIG. 4B is a cross-sectional view of the latch of FIG. 4A in a second, released position.

With reference to FIGS. 3-4B, a latch 78 is provided to engage the drive blade 42 and hold the drive piston 58 in a top dead center (TDC) position (FIG. 10A) until a trip member 82 extending from the reciprocating piston 58 actuates the latch 78 to disengage the drive blade 42. In the illustrated embodiment, the reciprocating piston 58 includes a first side 86 facing the drive piston 54 and a second side 90 opposite the first side 86, with the trip member 82 extending from the second side 90. With reference to FIG. 4A, the latch 78 is biased by a spring 94 to pivot the latch 78 about a pivot pin 98, towards the drive blade 42. The drive blade 42 includes a notch 102 in which a pin 106 on the latch 78 is received to engage the drive blade 42 and maintain the drive piston 54 in the TDC position. When the reciprocating piston 58 reaches a bottom dead center (BDC) position (FIG. 10C), the trip member 82 actuates the latch 78 by counteracting the biasing force of the spring 94 to pivot the pin 106 out of the notch 102, releasing the drive blade 42. Once the latch 78 has been disengaged from the drive blade 42, the drive blade 42 is thereby allowed to move under the influence of the driving force acting on the drive piston 54. In the illustrated embodiment, the pressure differential acting on the drive piston 54 increases as the reciprocating piston 58 approaches its BDC position. Both the drive piston 54 and the reciprocating piston 58 are movable between TDC positions (FIG. 10A) and BDC positions (FIG. 10C).

Figure 5A:
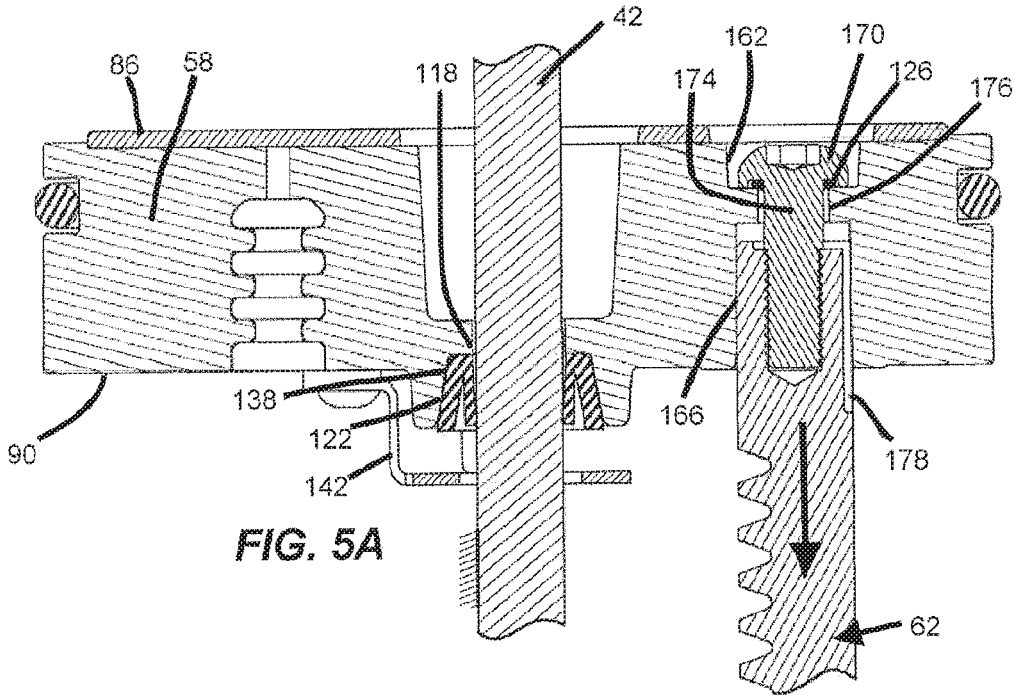
FIG. 5A is a cross-sectional view of a reciprocating piston of the powered fastener driver of FIG. 1 traveling in a first direction having seals in a first, sealed position taken along line 5A-5A in FIG. 2.
Figure 5B:
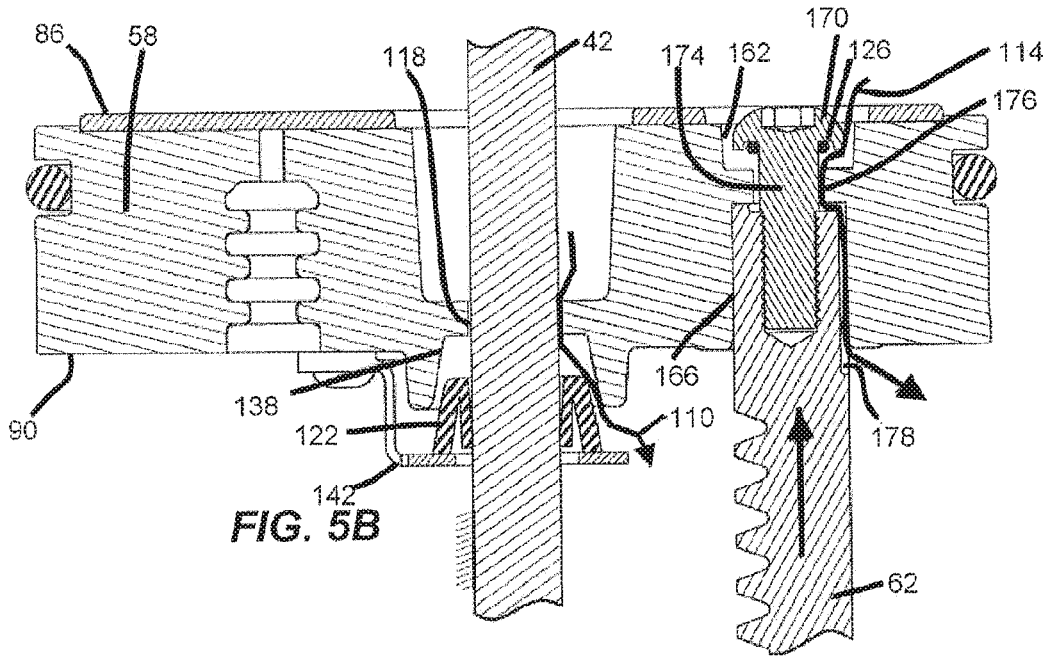
FIG. 5B is a cross-sectional view of the reciprocating piston of FIG. 5A traveling in a second direction having seals in a second, unsealed position.

With reference to FIG. 5B, leak paths 110, 114 through the reciprocating piston 58, when opened or unblocked, fluidly communicate portions of the cylinder 50 adjacent, respectively, opposite sides 86, 90 of the reciprocating piston 58. The reciprocating piston 58 includes an aperture 118 through which the drive blade 42 extends, and the fastener driver 10 further includes seals 122, 126 carried by the reciprocating piston 58. The seals 122,126 are movable relative to the reciprocating piston 58 between a first position (FIG. 5A) in which the seals 122, 126 are engaged with the reciprocating piston 58 for blocking the leak paths 110, 114, and a second position (FIG. 5B) in which the seals 122, 126 are disengaged from the reciprocating piston 58 for unblocking the leak paths 110, 114, respectively. In other words, the seals 122, 126, when in the first position, seal the variable-volume vacuum chamber 46, and the seals 122, 126, when in the second position, unseal the vacuum chamber 46 to fluidly communicate the vacuum chamber 46 with the space within the cylinder 50 below the reciprocating piston 58. In the illustrated embodiment, the reciprocating piston 58 includes both a blade seal 122 and a rack seal 126, the details of which are described below. In alternative embodiments, any number of seals may be included and the seals may be positioned on either the drive piston or the reciprocating piston.

Figure 5C:
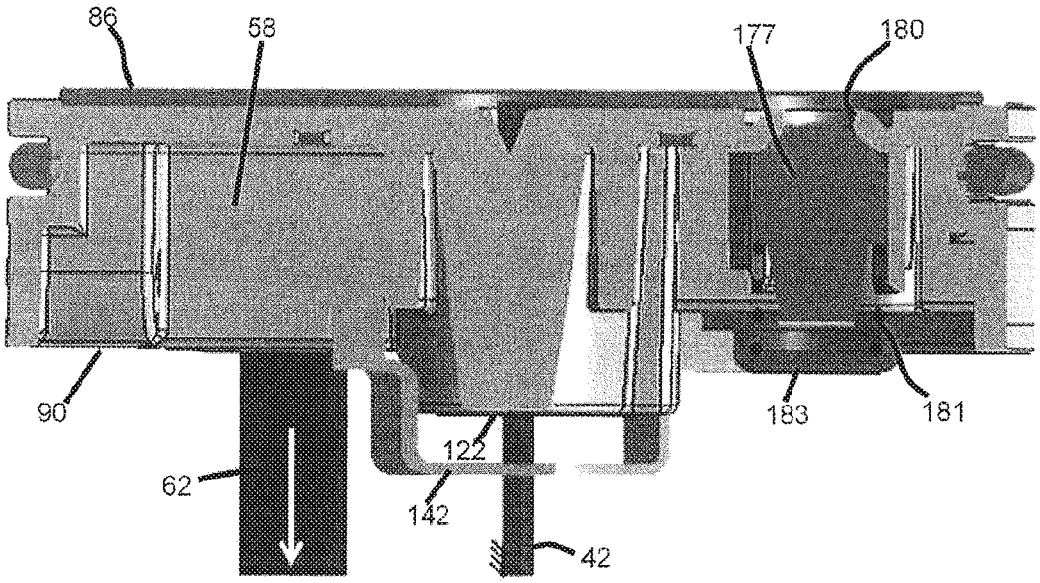
FIG. 5C is a cross-sectional view of the reciprocating piston of FIG. 5A traveling in the first direction having seals in the first, sealed position taken along line 5C-5C in FIG. 2.
Figure 5D:
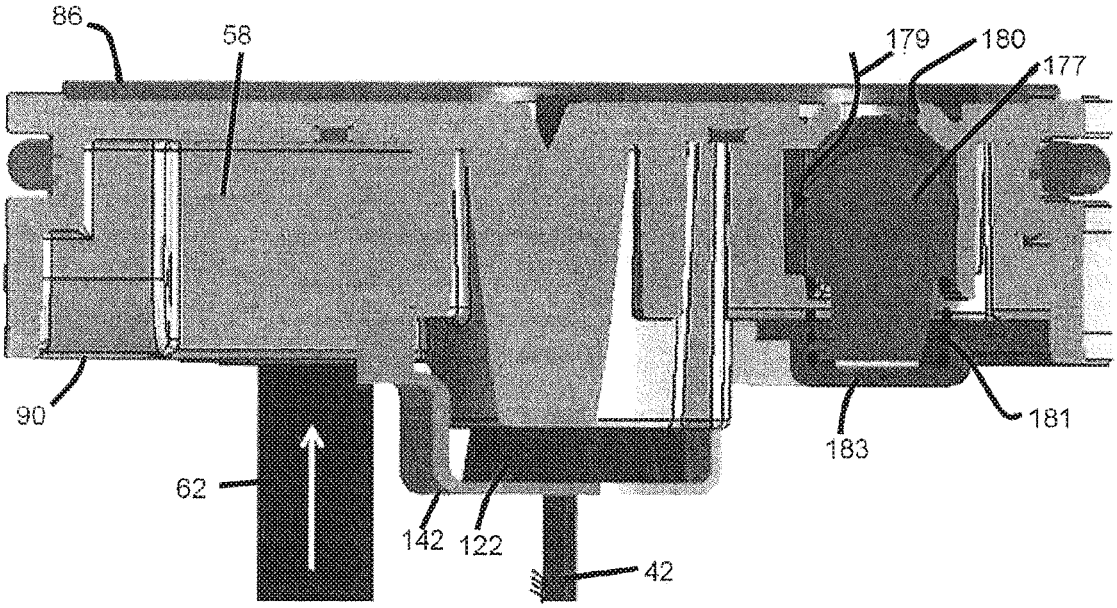
FIG. 5D is a cross-sectional view of the reciprocating piston of FIG. 5C traveling in the second direction having seals in the second, unsealed position.
Figure 6A:
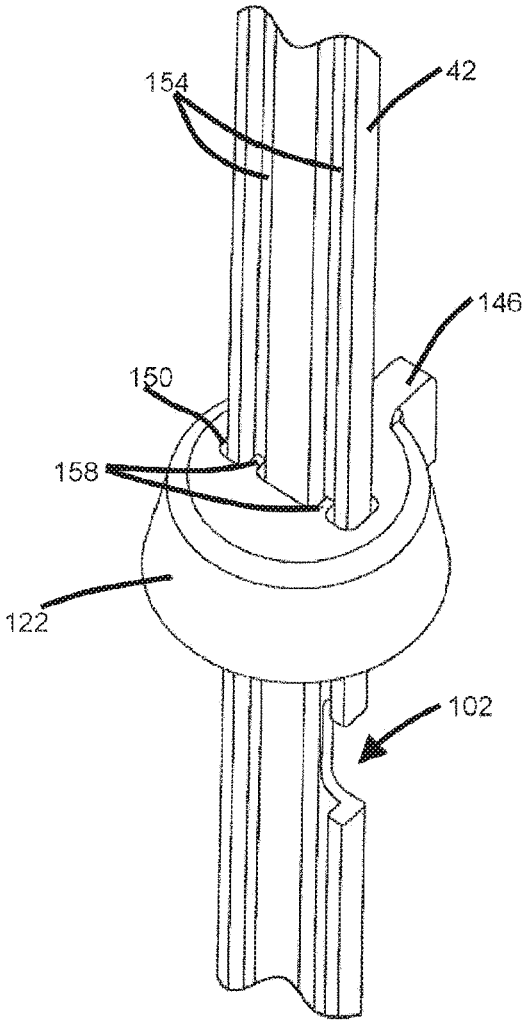
FIG. 6A is a top perspective view of a drive blade and blade seal of the powered fastener driver of FIG. 1.
Figure 6B:
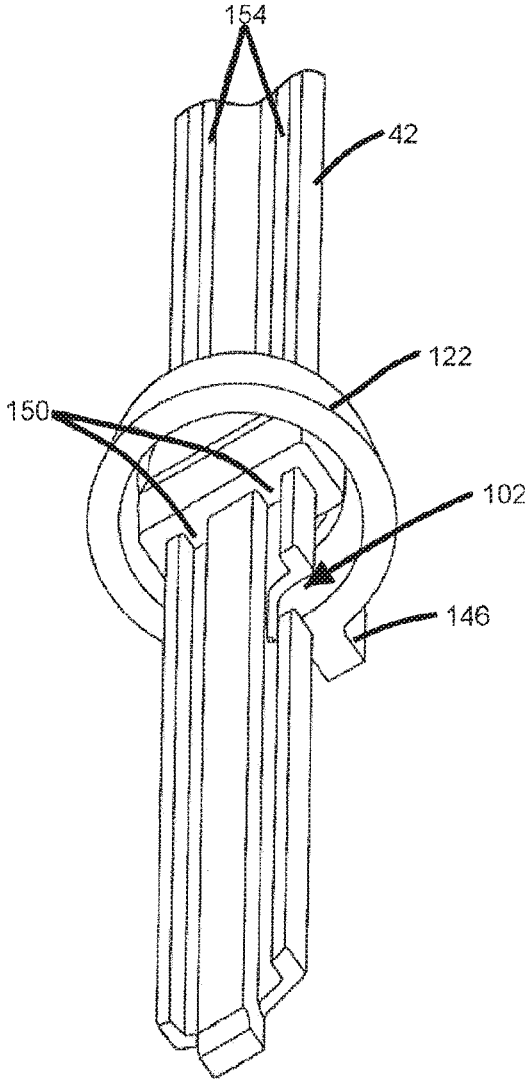
FIG. 6B is a bottom perspective view of the drive blade and blade seal of FIG. 6A.

With reference to FIGS. 5A-6B, the reciprocating piston 58 includes a recess 138 in which the blade seal 122 is received when in the first position, and a bracket 142 that supports the blade seal 122 when in the second position. The blade seal 122 includes a projection 146 (FIGS. 6A and 6B) to facilitate alignment of the blade seal 122 with the recess 138, and an aperture 150 through which the drive blade 42 passes. The blade seal 122 is moved between the first position (FIG. 5A) and second position (FIG. 5B) by relative movement between the reciprocating piston 58 and the drive blade 42, relying upon frictional contact between the blade seal 122 and the drive blade 42 to maintain a generally tight, sliding fit between the blade seal 122 and the drive blade 42. The leak path 110 is at least partially defined by the recess 138 when the blade seal 122 is in the second position and the aperture 118. In the illustrated embodiment, the drive blade 42 includes grooves 154 formed in one side of the drive blade 42, and the blade seal 122 includes ribs 158 extending into the grooves 154 to ensure fit between the drive blade 42 and blade seal 122 (FIGS. 6A and 6B).

With reference to FIGS. 5A and 5B, the reciprocating piston 58 includes a first recess 162 in which the rack seal 126 is received when in the first position, and a second recess 166 in which the rack 62 is received. A fastener 170 connects the rack 62 to the reciprocating piston 58, and the rack seal 126 is disposed around a shank 174 of the fastener 170. In the illustrated embodiment, the rack seal 126 is an O-ring. In alternative embodiments, the rack seal is a lip seal. The rack seal 126 is moved between the first position and the second position in response to relative movement between the rack 62 and the reciprocating piston 58 (i.e., when the rack 62 is driven upwards or downwards by the motor 74). The leak path 114 (FIG. 5B) is at least partially defined by the recesses 162, 166 and an aperture 176 communicating the recesses 162, 166 when the seal 126 is in the second position. In the illustrated embodiment, the leak path 144 is formed at least in part through a groove 178 formed in the rack 62. In alternative embodiments, the leak path is formed at least in part through a groove formed in the reciprocating piston.

With reference to FIGS. 5C and 5D, the reciprocating piston 58 further includes a check valve seal 177 and a leak path 179 (FIG. 5D) through the reciprocating piston 58 that when opened or unblocked, fluidly communicates portions of the cylinder 50 adjacent, respectively, opposite sides 86, 90 of the reciprocating piston 58. The check valve seal 177 is movable relative to the reciprocating piston 58 between a first position (FIG. 5C) in which the seal 177 is engaged with the reciprocating piston 58 for blocking the leak path 179, and a second position (FIG. 5D) in which the seal 177 is disengaged from the reciprocating piston 58 for unblocking the leak path 179. The leak path 179 is formed at least partially through an aperture 180 formed within the reciprocating piston 58. The check valve seal 177 is biased toward the first position by a spring 181 positioned between an end cap 183 and the check valve seal 177. The check valve seal 177 is moved between the first position and the second position in response to pressure created between the reciprocating piston 58 and the drive piston 54. For example, the seal 177 is moved from the first position to the second position in response to a positive pressure created between the reciprocating piston 58 and the drive piston 54. In the illustrated embodiment, the check valve seal 177 is in addition to the blade seal 122 and the rack seal 126.

However, in alternative embodiments, the blade seal 122 and the rack seal 126 can be omitted, and only the check valve seal 177 could be used in the reciprocating piston 58 for sealing and unsealing the leak path 179. In further alternative embodiments, any number or combination of the blade seal 122, rack seal 126, and check valve seal 177 can be used. For example, in some embodiments, two of the three seals 122, 126, and 177 could be utilized while, in other embodiments, only one of the three seals 122, 126, 177 could be utilized.

Figure 7B:
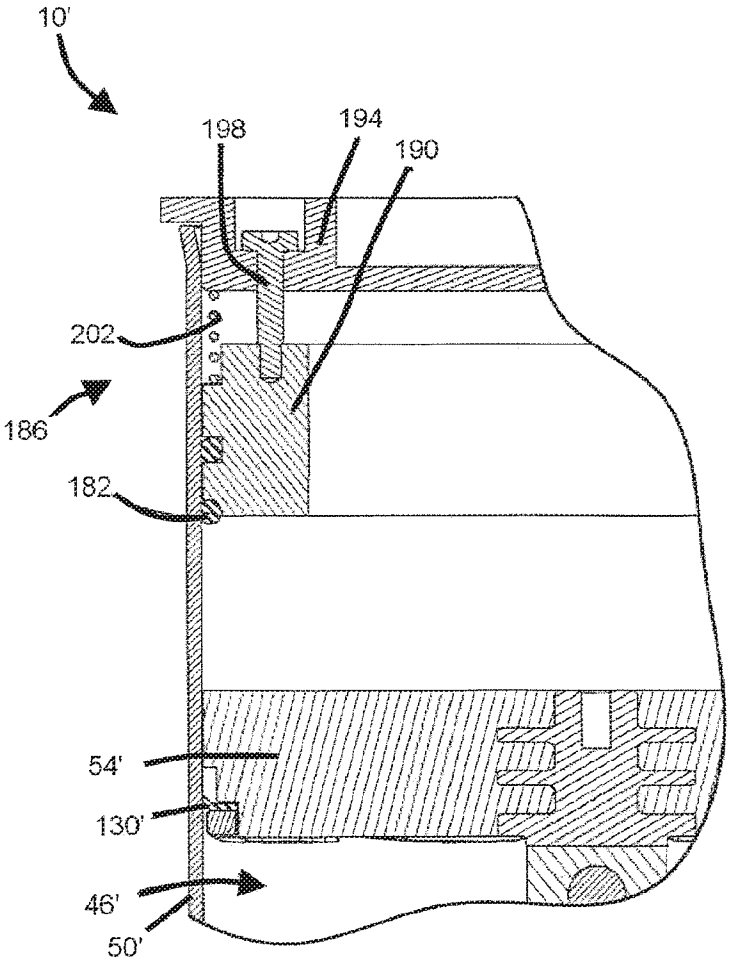
FIG. 7B is a partial, cross-sectional view of the backup static seal of FIG. 7A in a second, unsealed position.
Figure 7A:
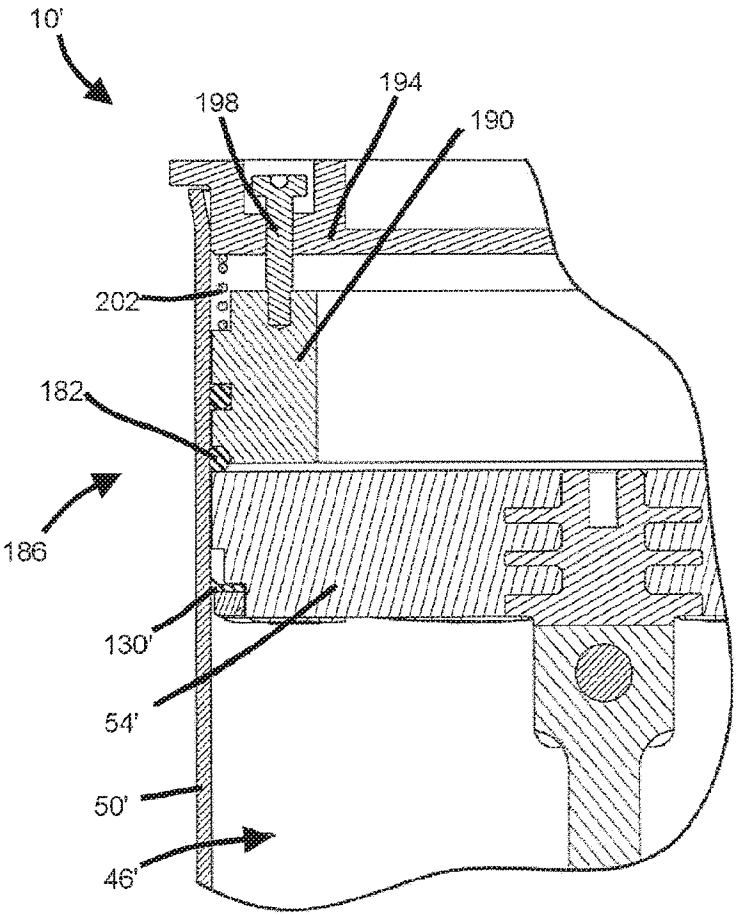
FIG. 7A is a partial, cross-sectional view of a backup static seal in accordance with another embodiment of the invention in a first, sealed position.

With reference to FIGS. 7A and 7B, an alternative embodiment of a powered fastener driver 10' is shown, with like components and features being shown with like reference numerals with a single prime (') mark. The driver 10' includes a backup static seal 182 located in a top portion 186 of the cylinder 50' and is coupled to a ring 190. The ring 190 is coupled to an end cap 194 via a stop screw 198 and is adjustable to set the distance the ring 190 is spaced from the cap 194. A spring 202 biases the ring 190 away from the end cap 194 and toward the drive piston 54'. When the drive piston 54' is being held in the TDC position (FIG. 7A), the outer periphery of the drive piston 54' abuts and compresses the backup static seal 182, displacing the ring 190 toward the end cap 194 against the bias of the spring 202, to further seal the variable volume vacuum chamber 46' from atmosphere. The backup static seal 182 works in conjunction with a dynamic piston seal (i.e., a lip seal 130') positioned around the periphery of the drive piston 54'. When the drive piston 54' is released from the TDC position (FIG. 7B), the backup static seal 182 is returned by the spring 202 to the extended position, which is determined by the stop screw 198.

Figure 8:
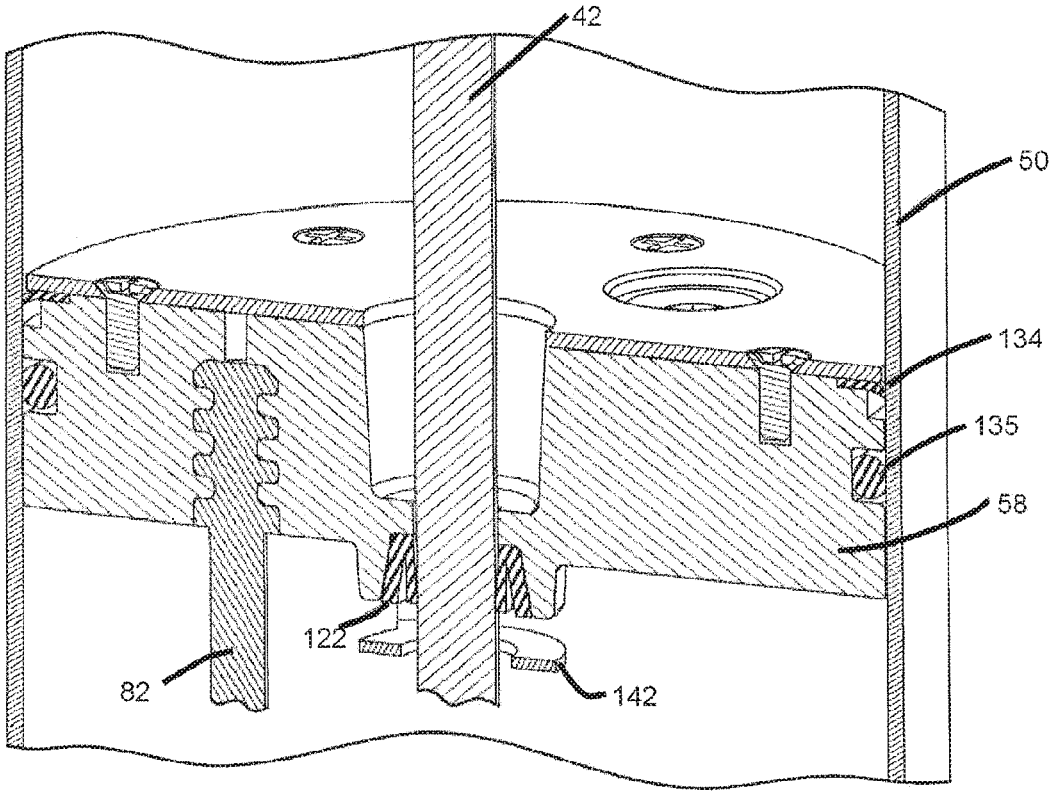
FIG. 8 is a cross-sectional view of a reciprocating piston with a lip seal in accordance with another embodiment of the invention.

In the illustrated embodiment, the fastener driver 10 further includes a first lip seal 130 coupled to a circumference of the drive piston 54 and extending radially outward to contact the cylinder 50 (FIG. 2). In alternative embodiments, the fastener driver includes a second lip seal 134 coupled to a circumference of the reciprocating piston 58 and extending radially outward to contact the cylinder 50 (FIG. 8). The second lip seal 134 works in combination with an O-ring seal 135. In alternative embodiments, the O-ring seal 135 is replaced with an additional lip seal.

Figure 9B:
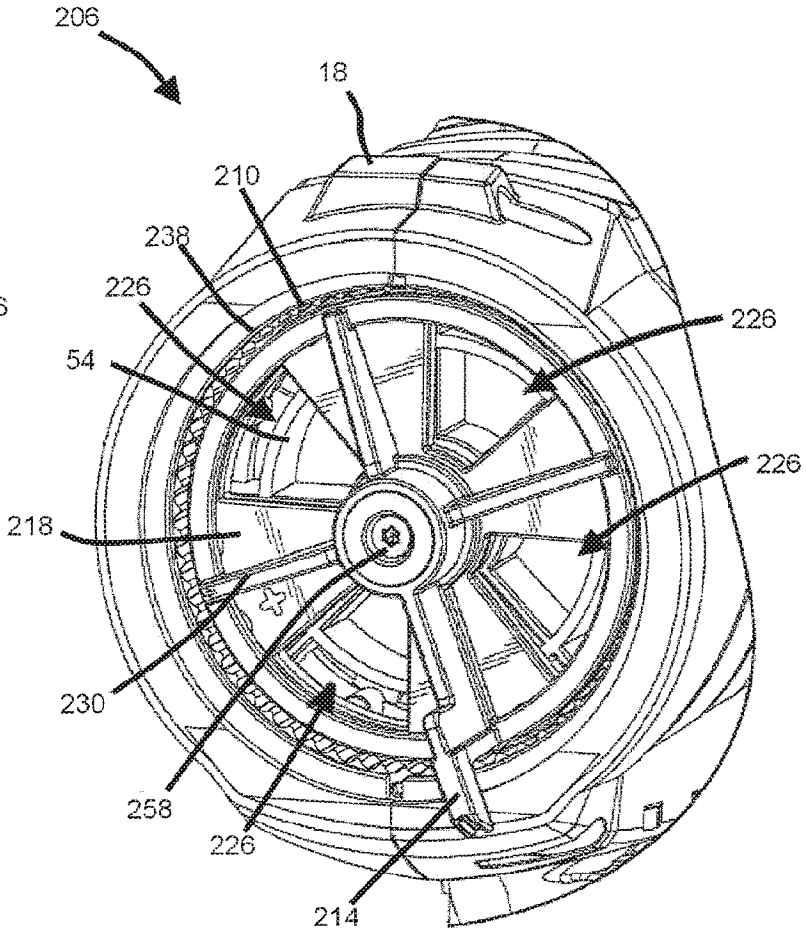
FIG. 9B is a rear perspective view of the adjustable valve of FIG. 9A in a second position.
Figure 9A:
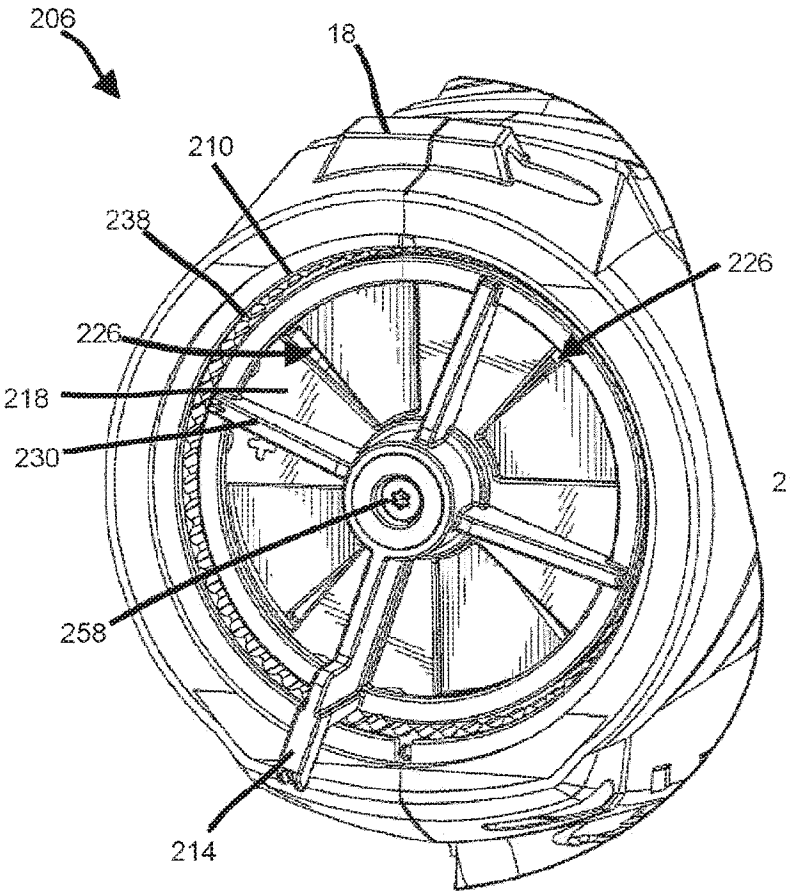
FIG. 9A is a rear perspective view of an adjustable valve of the powered fastener driver of FIG. 1, in a first position with some components removed for clarity.
Figure 9C:
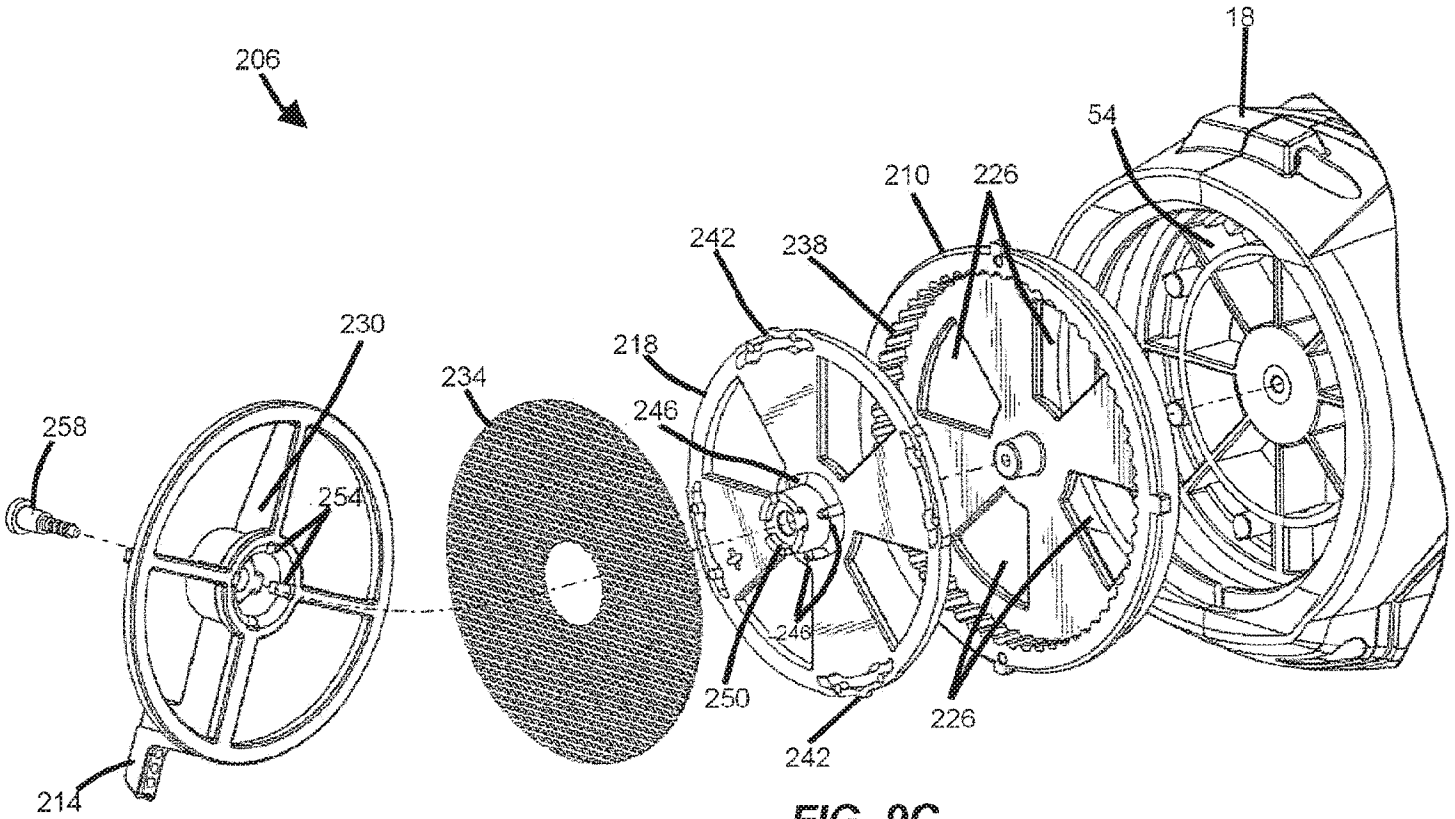
FIG. 9C is an exploded view of the adjustable valve of FIG. 9A.

With reference to FIGS. 9A-9C, the powered fastener 10 further includes an adjustable valve for selectively introducing air from ambient atmosphere into the cylinder 50, thereby changing the pressure differential acting on the drive piston 54 which, in turn, changes a driving depth of the fasteners. In the illustrated embodiment of the powered fastener 10, the adjustable valve is configured as an adjustable shutter assembly 206 including an end cap 210, an adjustment mechanism (i.e., a lever 214), and a shutter 218 (FIG. 9C). The end cap 210 is secured to a top portion 222 of the cylinder 50 and includes apertures 226 formed therein. In the illustrated embodiment, the adjustable shutter assembly 206 is located above the drive piston 54 in the top portion 222 of the cylinder 50. The lever 214 is manipulatable by a user of the fastener driver 10 and is integrally formed with a frame 230 that is securely attached to the shutter 218 for co-rotation therewith. The shutter 218 is rotatable to block part of (FIG. 9A), or none (FIG. 9B) of the apertures 226 formed in the end cap 210. When the apertures 226 are unblocked by the shutter 218, either partially or fully, the apertures 226 are exposed to atmospheric pressure. In other words, the lever 214 is rotatable to adjust the amount of air from ambient atmosphere that can be drawn into the cylinder 50 and above the drive piston 54. In alternative embodiments, the lever 214 can by any type of adjustment member (e.g., a knob, a slide, etc.) and can be movable in any fashion (e.g., by pivoting, sliding, etc.).

With reference to FIG. 9C, an exploded view of the adjustable shutter assembly 206 is illustrated. The end cap 210 includes a plurality of teeth 238 that are engageable by opposed detents 242 provided on the shutter 218 for holding the shutter 218 and lever 214 in the positions shown in FIGS. 9A and 9B, and any intermediate position therebetween. With reference to FIG. 9C, a screen 234 (not shown for clarity in FIGS. 9A and 9B) is sandwiched between the frame 230 and the shutter 218, and prevents outside debris from entering the cylinder 50 through the apertures 226. The frame 230 is secured to the shutter 218 for co-rotation therewith by ribs 246 formed on a hub 250 of the shutter 218 that are received in corresponding grooves 254 formed in the frame 230. In addition, a fastener 258 secures the frame 230, the shutter 218, and the end cap 210 to the housing 18. In alternative embodiments, the lever, the frame, the shutter, and the screen can be integrally formed as a single component.

By adjusting the lever 214, and correspondingly the portion of each of the apertures 226 blocked by the shutter 218, a user may adjust the force applied to the drive piston 54 and the drive blade 42. Specifically, the shutter 218 adjusts the pressure differential acting on the drive piston 42 by providing a controlled leak through the apertures 226 to atmospheric pressure. For example, with the majority of each aperture 226 closed (FIG. 9A) a relatively low pressure, or even a competing vacuum, is formed in the cylinder 50 above the drive piston 54 as it descends in the cylinder 50. This yields a relatively small pressure differential acting on the drive piston 54, causing the drive piston 54 and the drive blade 42 to be driven with a relatively lower force. Alternatively, with the apertures 226 completely unblocked by the shutter 218 (FIG. 9B), the top of the drive piston 54 is exposed to substantially atmospheric pressure as it descends in the cylinder 50. This yields a relatively large pressure differential acting on the drive piston 54, causing the drive piston 54 and the drive blade 42 to be driven with a relatively higher force.

Figure 10B:
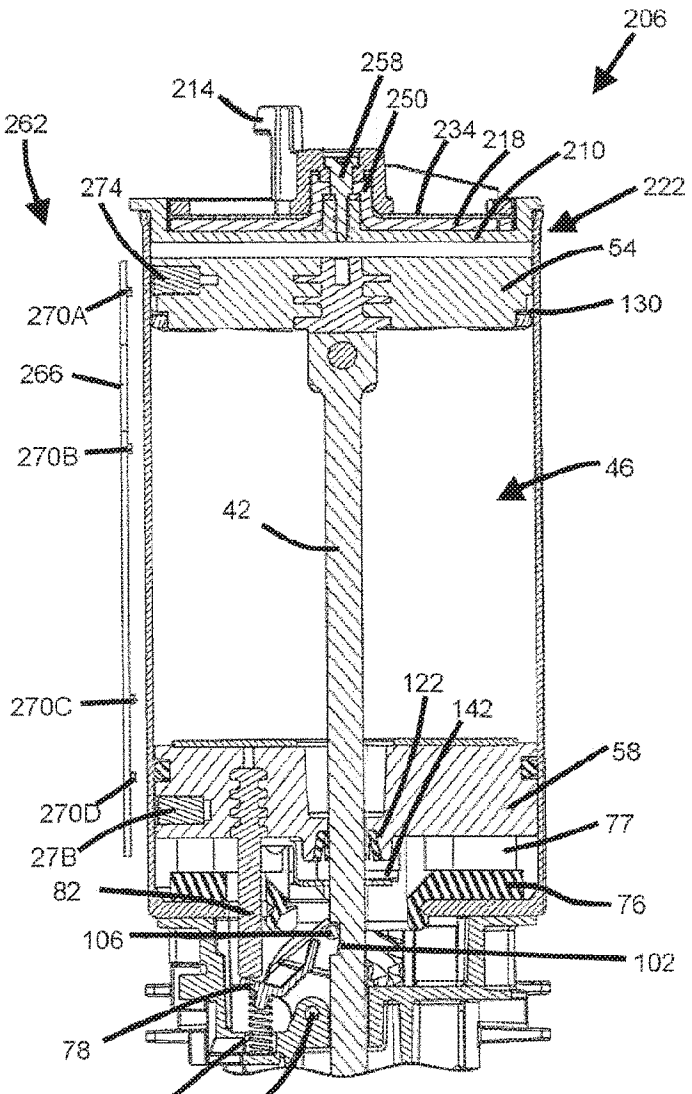
FIG. 10B is a cross-sectional view of the powered fastener driver of FIG. 10A illustrating the reciprocating piston in a bottom dead center position and the drive piston in the top dead center position.
Figure 10A:
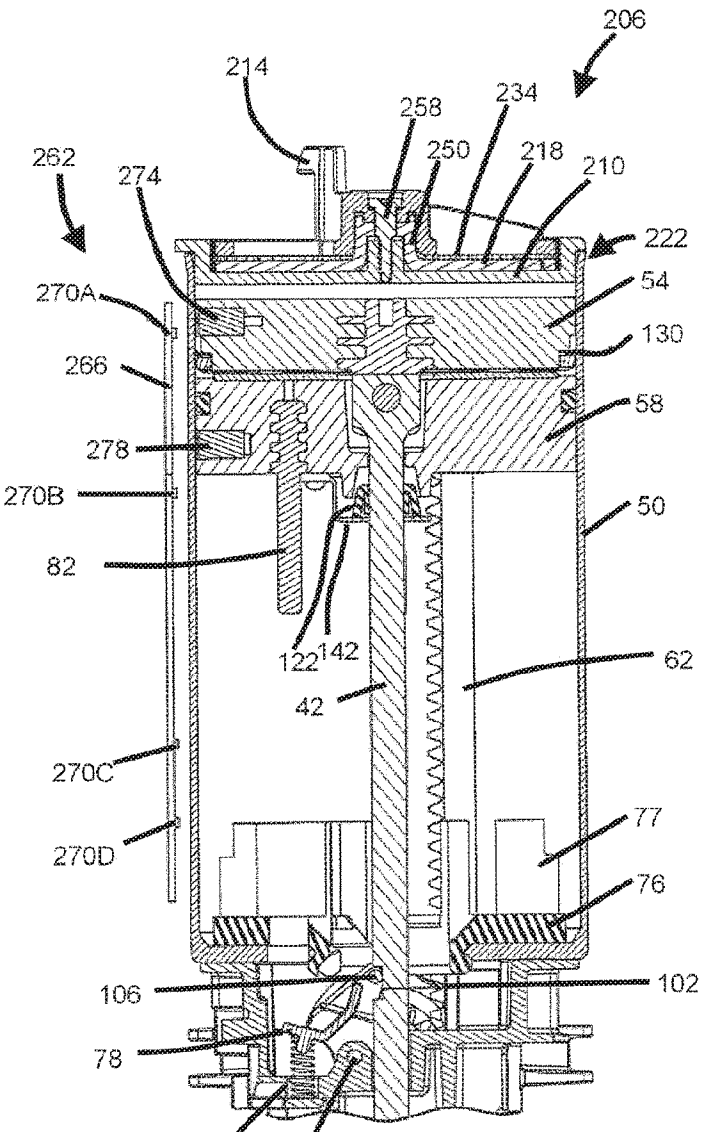
FIG. 10A is a cross-sectional view of the powered fastener driver of FIG. 1 illustrating both the reciprocating piston and a drive piston in a top dead center position.
Figure 10D:
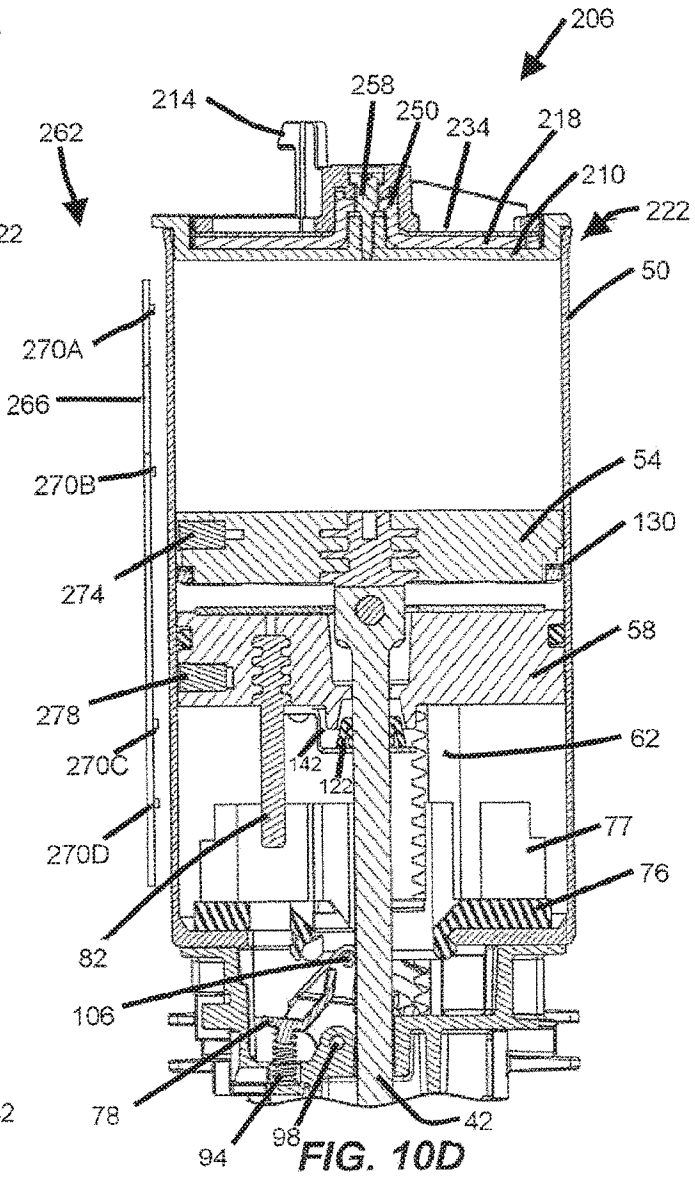
FIG. 10D is a cross-sectional view of the powered fastener driver of FIG. 10A illustrating an upward stroke of the reciprocating piston and the driver piston toward the top dead center positions for both pistons.
Figure 10C:
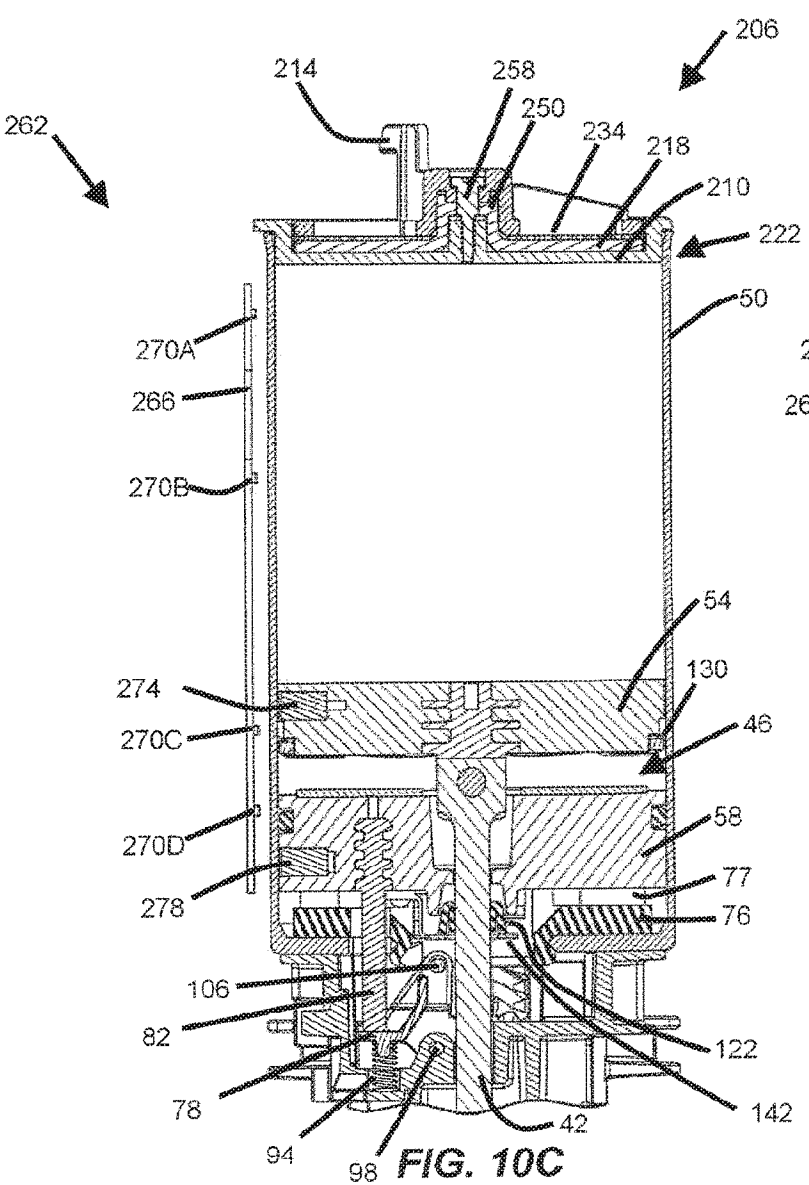
FIG. 10C is a cross-sectional view of the powered fastener driver of FIG. 10A illustrating both the reciprocating piston and the driver piston in a bottom dead center position.

In operation, the vacuum powered fastener driver 10 undergoes a drive cycle, shown in FIGS. 10A-10D, that is repeated to drive each successive fastener. With reference to FIG. 10A, the drive cycle begins with both the reciprocating piston 58 and the drive piston 54 located in the TDC position. The reciprocating piston 58 is then lowered by the rack 62 to expand the vacuum chamber 46, thereby creating a pressure differential acting on the drive piston 54. The drive piston 54 however, is held in its TDC position by the latch 78, as shown in FIG. 10B. As the reciprocating piston 58 is lowered by the rack 62, the leak paths 110, 114 are closed by the blade seal 122 and the rack seal 126, as described above, to seal off the first side 86 of the reciprocating piston 58 from the second side 90. With reference to FIG. 10C, when the reciprocating piston 58 reaches its BDC position, the trip member 82 actuates the latch 78 to disengage the drive blade 42, thereby releasing the drive piston 54. At this time, the drive piston 54 is acted upon by a driving force caused by the pressure differential to accelerate the drive piston 54 toward the reciprocating piston 58 for driving a fastener with the driver blade 42. Finally, with reference to FIG. 10D, the reciprocating piston 58 is driven back to its TDC position by the rack 62. The reciprocating piston 58 also pushes or lifts the drive piston 54 back to its TDC position as well. As the reciprocating piston 58 is driven back to its TDC position, the leak paths 110, 114 are opened by the blade seal 122 and the rack seal 126, as described above, to fluidly communicate the first side 86 of the reciprocating piston 58 with the second side 90. When the drive piston 54 is returned to its TDC position, the latch 78 re-engages the drive blade 42 to lock the drive piston 54 into its TDC position (FIG. 10A).

The drive cycle is initiated when a user actuates the trigger 26. Electrical power to the motor 74 is provided through the trigger 26 such that if a user releases the trigger 26 as the reciprocating piston 58 is moving away from the drive piston 54 during a fastener driving sequence, the drive cycle is stopped before the fastener is driven. However, in order to ensure proper operation, electrical power only passes through the trigger 26 for the nail driving sequence (i.e., with the drive blade 42 being driven downward), and the motor 74 can still operate to return the reciprocating piston 58 and the drive piston 54 to their TDC positions when the trigger 26 is not depressed. After the drive cycle has been stopped in response to releasing the trigger 26, the reciprocating piston 58 is driven back toward its TDC position by the motor 74, which is powered through an alternative electrical circuit. In other words, if the trigger 26 is released while the reciprocating piston 58 is moving down to create a vacuum in the chamber 46, the electrical power to the motor 74 is stopped and the downward stroke of the piston 58 is halted. Then, the motor 74 is provided electrical power through the alternative circuit to return the reciprocating piston 58 back to its TDC position.

With reference to FIGS. 2 and 10A-10D, the powered fastener 10 further includes a monitoring system 262 having a circuit board 266 with a plurality of sensors 270A-270D (e.g., Hall-effect sensors) spaced along the cylinder 50 and operable to detect magnets 274, 278 positioned in the drive piston 54 and the reciprocating piston 58, respectively. With reference to FIGS. 10A-10D, for illustrative clarity the circuit board 266 and the corresponding sensors 270A-270D have been illustrated in profile, alongside the cross-sectional view of the cylinder 50 with the corresponding magnets 274, 278 shown adjacent the circuit board 266. In other words, the circuit board 266 and magnets 274, 278 are positioned out of the cross-sectional plane of FIGS. 10A-10D (see FIG. 2), but are shown in profile schematically in FIGS. 10A-10D for illustrative purposes. In alternative embodiments, the circuit board and corresponding magnets can be in any circumferential position around the cylinder 50. In the illustrated embodiment, there are four sensors 270A-270D that are cooperatively able to determine the presence and direction of the drive piston 54 and the reciprocating piston 58. Any two sensors 270A-270D can work in combination to determine the average speed and direction the pistons 54, 58 are traveling. The spacing of the sensors 270A-270D is illustrated as such so that the sensors 270A and 270B are close together and sensors 270C and 270D are close together when compared to the space between sensors 270B and 270C. The magnets 274, 278 are positioned within the drive piston 54 and the reciprocating piston 58, respectively, and the magnets 274, 278 are oriented to be detectable by the sensors 270A-270D as the pistons 54, 58 come into proximity with the sensors 270A-270D. In alternative embodiments, the sensors can uniquely identify which of the drive piston and the reciprocating piston has passed by the sensor. The top-most sensor 270A is positioned to identify when the drive piston 54 is being held in its TDC position. The bottom-most sensor 270D is positioned to identify when the reciprocating piston 58 has reached its BDC position.

Figure 11:
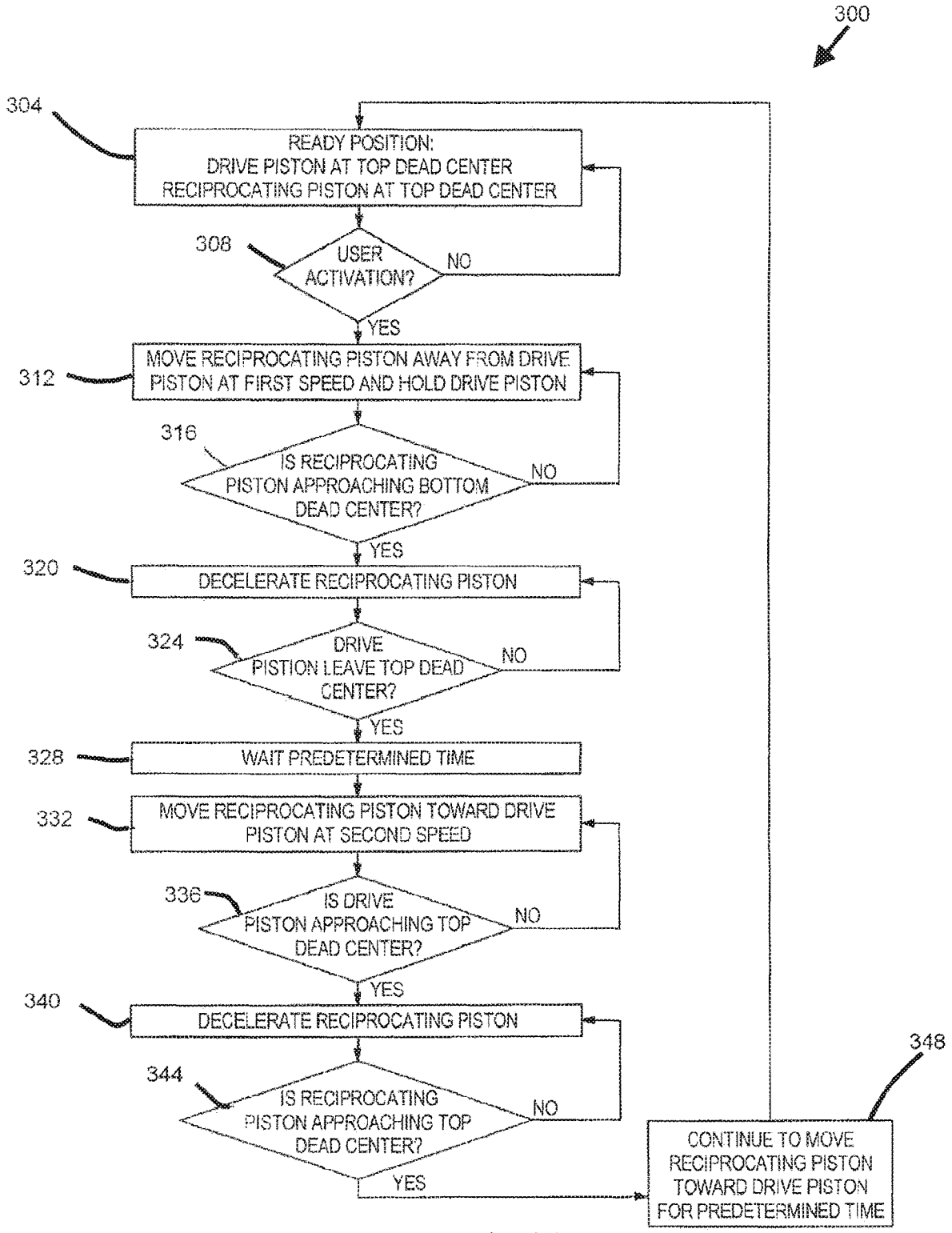
FIG. 11 is a flow chart illustrating a method of operating the powered fastener driver of FIG. 1.

With regard to FIG. 11, a method 300 of operating the fastener driver 10 under normal conditions is illustrated. The method 300 begins at a ready position with the drive piston 54 and the reciprocating piston 58 in the TDC position (FIG. 10A, Step 304), and the method 300 is initiated with user activation of the trigger 26 (Step 308). Following user activation, the method 300 includes the steps of moving the reciprocating piston 58 away from the drive piston 54 at a first speed while the drive piston 54 is maintained at the TDC position (Step 312). The method 300 further includes detecting the reciprocating piston 58 with the monitoring system 260 prior to the reciprocating piston 58 reaching the BDC position within the cylinder 50 (Step 316), and decelerating the reciprocating piston 58 from the first speed in response to being detected (Step 320). In other words, the reciprocating piston 58 is slowed to prevent impacting the bumper 76 with high forces after the magnet 278 is detected by the sensor 270D (FIG. 10B). After the reciprocating piston 58 reaches the BDC position and the trip member 82 moves the latch 78 out of engagement with the drive blade 42, as described above, the monitoring system 262 detects the drive piston 54 has left the TDC position (FIG. 10C, Step 324) and waits for a predetermined amount of time (e.g., 2 ms) (Step 328) before the reciprocating piston 58 is driven toward the drive piston 54 at a second speed (FIG. 10D, Step 332). The method 300 further includes detecting the drive piston 54 with the monitoring system 262 prior to the drive piston 54 reaching the TDC position (Step 336), and decelerating the reciprocating piston 58 from the second speed in response to being detected (Step 340). In other word, the magnet 274 in the drive piston 54 is detected by the sensors 270A and the reciprocating piston 58 is slowed. In addition, the method 300 includes detecting the reciprocating piston 58 with the monitoring system 262 prior to the reciprocating piston 58 reaching the TDC position (Step 344), and continuing to move the reciprocating piston 58 toward the drive piston 54 for a predetermined period of time (e.g., 100 ms, 150 ms, etc.) (Step 348). In alternative embodiments, the predetermined periods of time can be adjusted according to power available in the battery 34. By continuing to move the reciprocating piston 58 toward the drive piston 54 for a predetermined period of time (Step 348), any air that was trapped between the drive piston 54 and the reciprocating piston 58 can be driven beneath the reciprocating piston 58 through the open valves 122, 126, so that the drive piston 54 and reciprocating piston 58 can be fully returned to their TDC positions to assume a ready position for the next drive cycle (Step 304).

Figure 12:
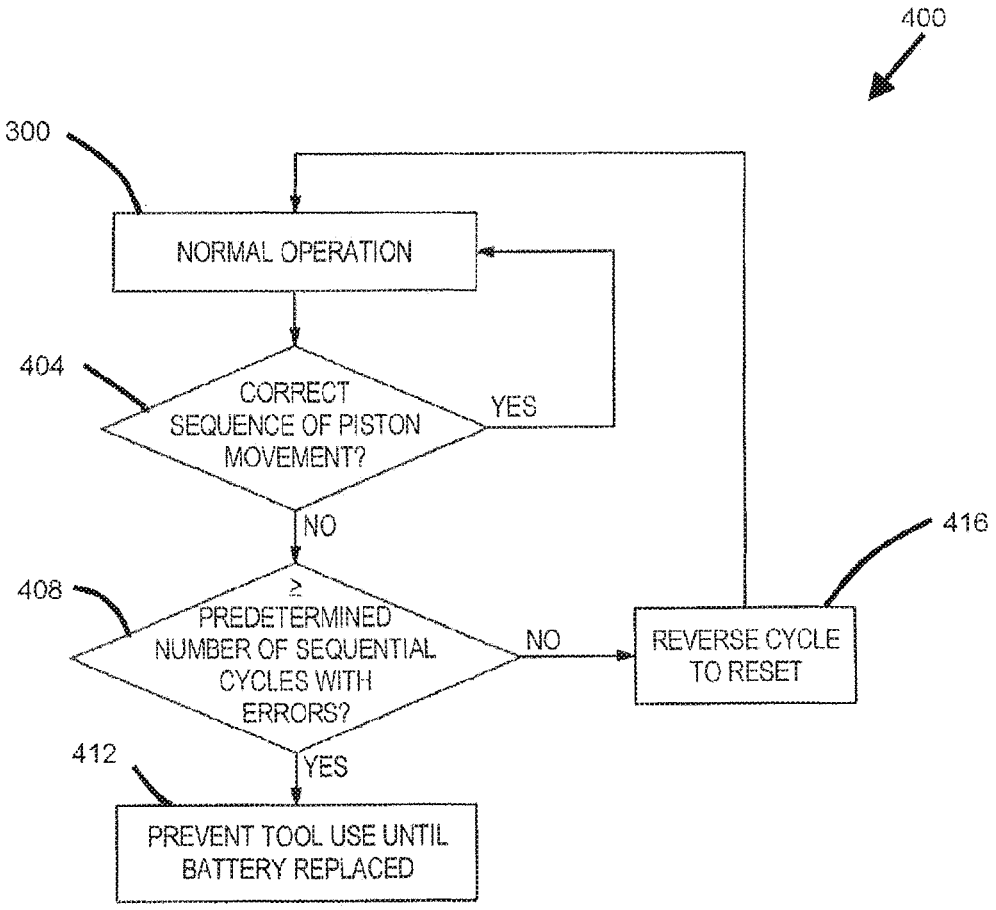
FIG. 12 is a flow chart illustrating the method of operating the powered fastener driver of FIG. 1 under abnormal conditions.

With reference to FIG. 12, the method 300 of operating the fastener driver 10 is expanded to illustrate a method of operation 400 under abnormal conditions. The method 400 includes the steps of detecting abnormal operation with the monitoring system 262. Abnormal operation is detected by the monitoring system 262 when the sequence of piston movement, which is tracked by the magnets 274, 278, passing by the sensors 270A-270D is not correct (Step 404). If the sequence of piston movement is not correct, the method 400 considers if the number of sequential abnormal cycles is greater than a predetermined number (e.g., 2, 3, 5, etc.) (Step 408). If the number of sequential abnormal cycles is greater than the predetermined number, the fastener driver is shut down and use of the fastener driver 10 is prevented until the battery 34 is removed and replaced (Step 412). If the number of sequential abnormal cycles is less than the predetermined number, the pistons 54, 58 are returned to their TDC position to reset the drive cycle (Step 416). Once the pistons 54, 58 are in their TDC positions, the powered fastener 10 is ready for a normal drive cycle (Step 304).

Figure 13A:
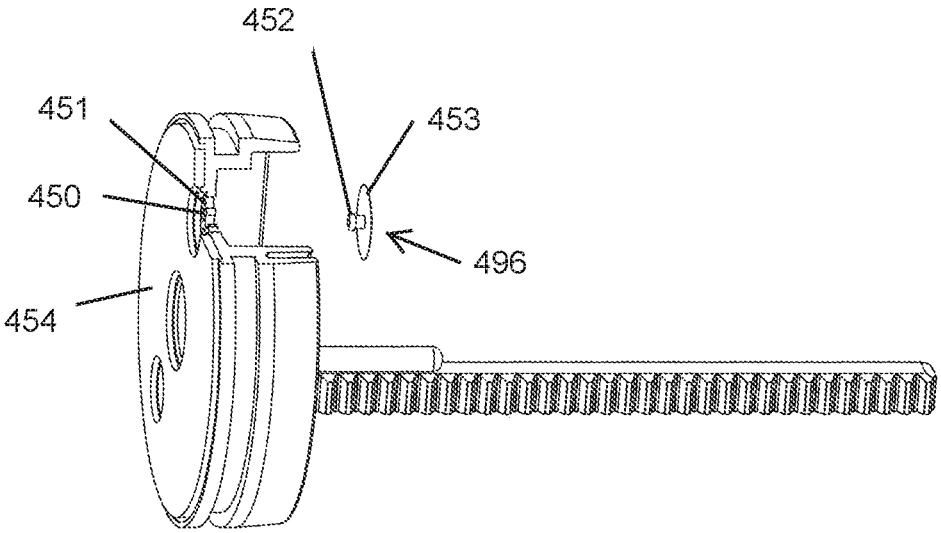
FIGS. 13A-13D show various check valves used in the powered fastener driver in alternative embodiments.

With reference to FIGS. 13A-13D, alternative embodiments of the present invention include different types of check valves used in the reciprocating piston of the fastener driver. In FIG. 13A, on the reciprocating piston 454 there are formed a plurality of leaking pore 451. The leaking pores 451 are aligned on a circumferential direction surrounding a center aperture (not shown) through which the umbrella shaped leak 450 movably passes through. The umbrella shaped leak 450 contains an umbrella cover 453 in substantially round shape, and an umbrella pin 452 connected to the umbrella cover 453 on one side thereof. The umbrella shaped leak 450 when inserted in the center aperture is capable of moving between a first position and a second position. In the first position, the umbrella cover 453 is away from the leaking pores 451 so that leak paths created by the leaking pores 451 are opened. In the second position, the umbrella cover 453 approximates and closes the leaking pores 451 so that leak paths created by the leaking pores 451 are closed. The umbrella shaped leak 450 is moved between the first position and the second position in response to pressure created between the reciprocating piston 451 and the drive piston (not shown), similar to the work principle described in above embodiments.

Figure 13B:
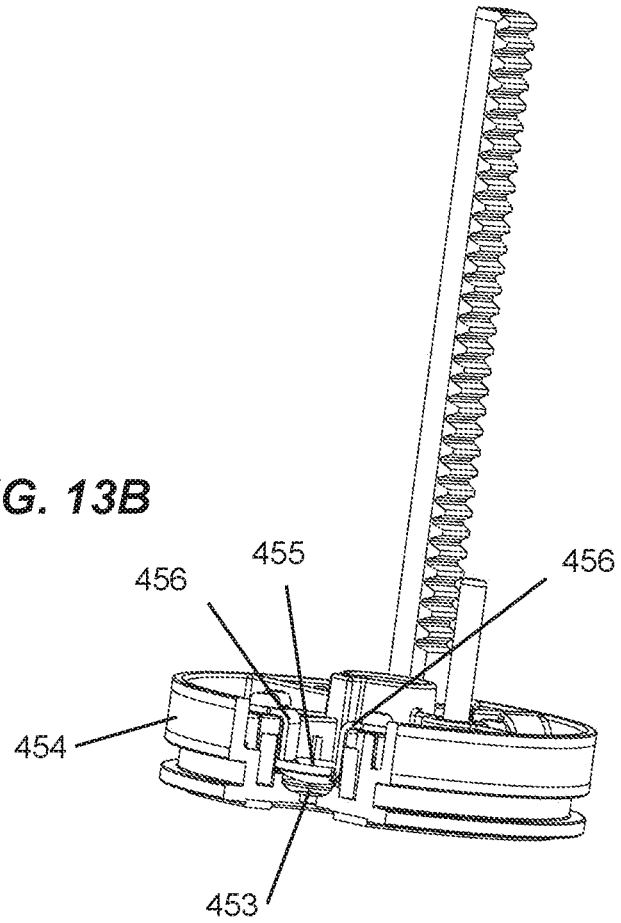

The check valve shown in FIG. 13B is a variation of the check vale shown in FIG. 13A. In addition to the umbrella cover 453 used for closing any leaking pores on the reciprocating piston, a pressure plate is superimposed on top of the umbrella cover 453 to further improve strength of the umbrella cover 453. The pressure plate has a bottom part 455 in substantially the same shape as the umbrella cover 453, and two side arms 456 connected to the bottom part 455. The side arms 456 help to align the pressure plate with the umbrella cover 453 by pressing against side walls formed on the reciprocating piston.

Figure 13C:
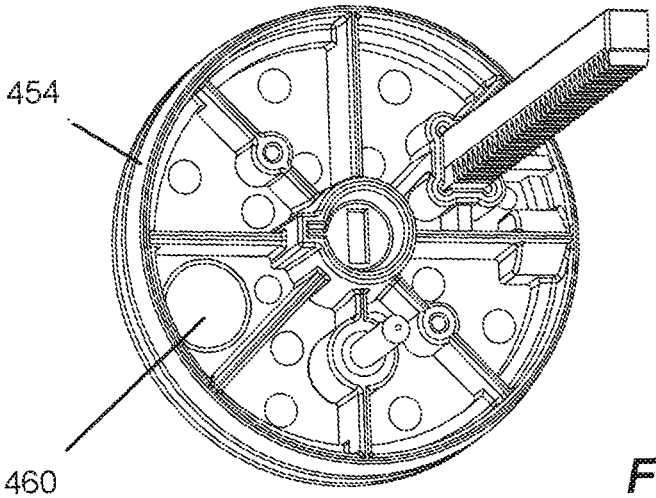

In FIG. 13C, a cancel valve is used to take the place of a movable leak to control pressure created between the reciprocating piston 451 and the drive piston (not shown). As skilled persons would understand, any type of suitable cancel valve may be used for this purpose.

Figure 13D:
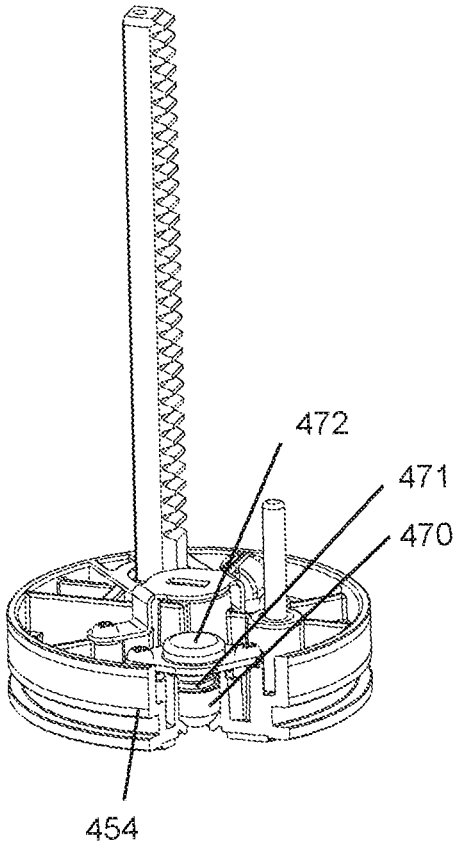

The check valve shown in FIG. 13D on the other side is similar to the one shown in FIGS. 5C and 5D. The check valve seal 470 is movable relative to the reciprocating piston 454 between a first position in which the seal 470 is engaged with the reciprocating piston 454 for blocking a leak path (not shown), and a second position in which the seal 470 is disengaged from the reciprocating piston 454 for unblocking the leak path. The check valve seal 470 is biased toward the first position by a spring 471 positioned between an end cap 472 and the check valve seal 470.

The check valve seal 470 is moved between the first position and the second position in response to pressure created between the reciprocating piston 454 and the drive piston (not shown). Preferably, a small amount of grease is applied to the check valve seal 470 and/or spring 471 to reduce the frictions and aid in their sliding.

Figure 14A:
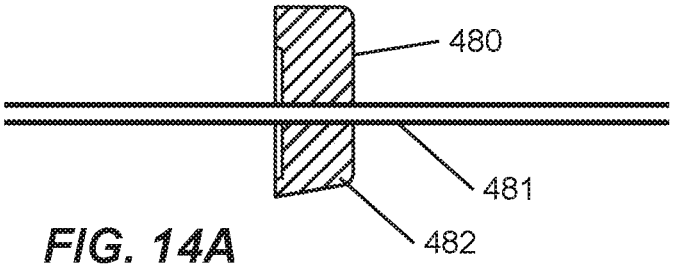
FIGS. 14A-14G show various blade seals used in the powered fastener driver in alternative embodiments.
Figure 14B:
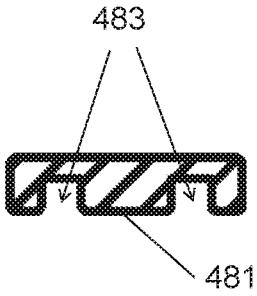
Figure 14C:
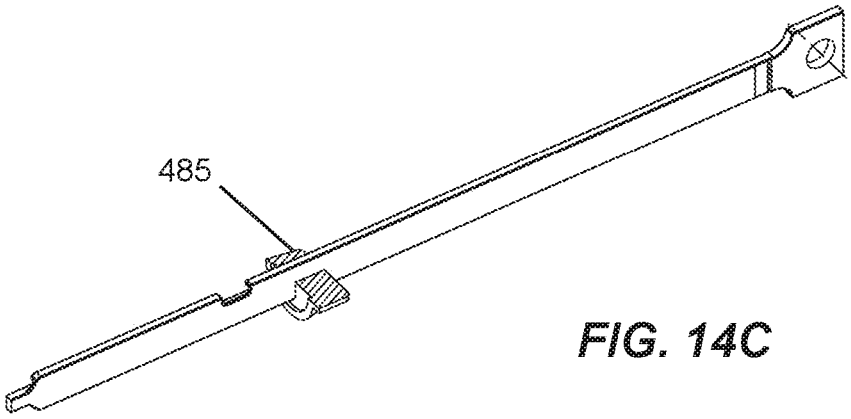
Figure 14D:
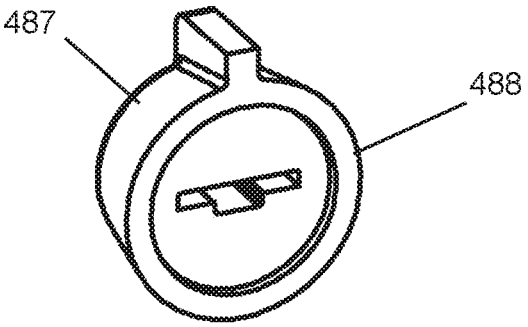
Figure 14E:
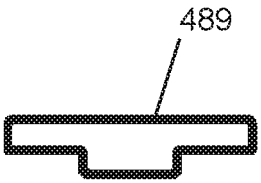
Figure 14F:
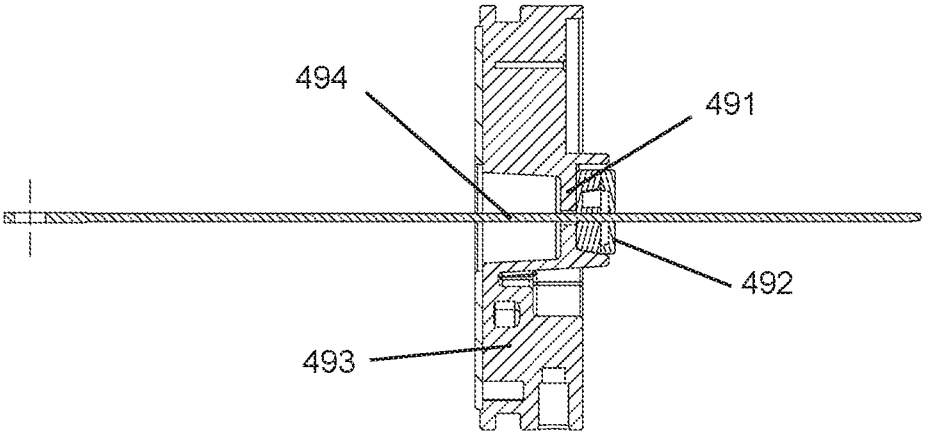
Figure 14G:
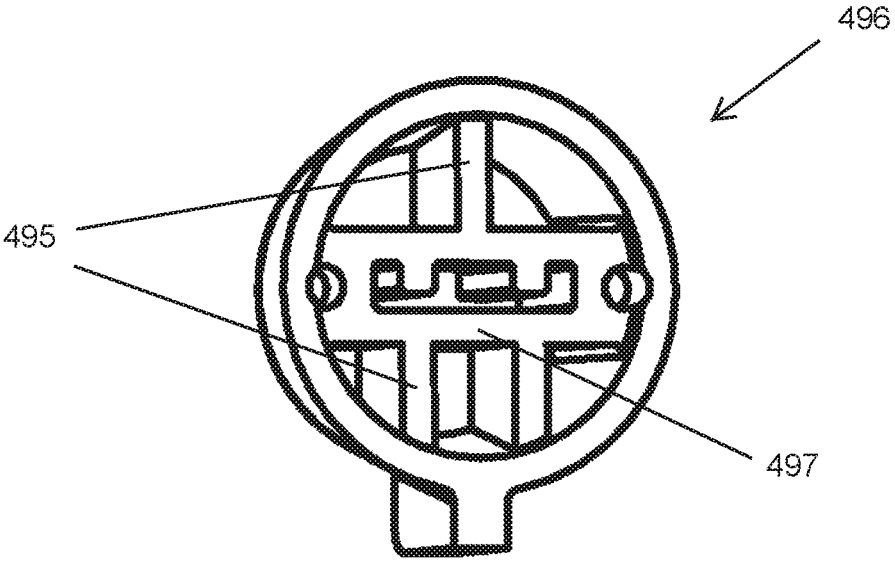

With reference to FIGS. 14A-14G, alternative embodiments of the present invention illustrate different types of blade seals used in the reciprocating piston of the fastener driver. As mentioned above, the blade seal is received in a recess formed in the reciprocating piston to provide a sliding fit between the drive blade and the blade seal, and that the blade seal is adapted to move between different positions to enable/disable the sealing effect. The blade seal 480 in FIG. 14A is similar to the blade seal in FIGS. 6A and 6B in that the blade seal 480 also contains a ring shaped recess 482 around the center aperture formed in the blade seal 480. The drive blade 481 is adapted to slide in the center aperture relative to the blade seal 480. As shown in FIG. 14A, the drive blade 481 has a substantially "E" shaped cross section, and it contains two grooves 483 formed in one side of the drive blade 481 to match with ribs formed on the contacting surfaces (not shown) of the blade seal 480 to ensure fit between the drive blade 481 and blade seal 480. In FIG. 14B, the blade seal 485 is different from that in FIG. 14A in that the blade seal 485 is a solid component, without any open recess as shown in FIG. 14A. In FIG. 14C, the blade seal 487 is similar to that in FIG. 14B as the blade seal 487 is solid and does not have any open recess. However, the drive blade 489 in this embodiment is in substantially "T" shape. Accordingly, the central aperture 488 formed on the blade seal 487 is also in "T" shape. The blade seal shown in FIG. 14D on the other side utilizes two layers of seal members, namely a first seal part 492 and a second seal part 491. The first seal part 492 and the second seal part 491 are superimposed in the recess formed on the reciprocating piston 493. The two layers of seal members result in increasing of area of contacting surfaces between the drive blade 494 and the reciprocating piston 493, therefore improving the sealing performance. Lastly, in FIG. 14E there is shown a plurality of support ribs 495 connecting the side walls of the blade seal 496 with the central member 497 in which the central aperture for slidably receiving the drive blade (not shown) is formed. The support ribs 495 provide additional support to the central member 497 to increase strength of the central member 497.

Figure 15:
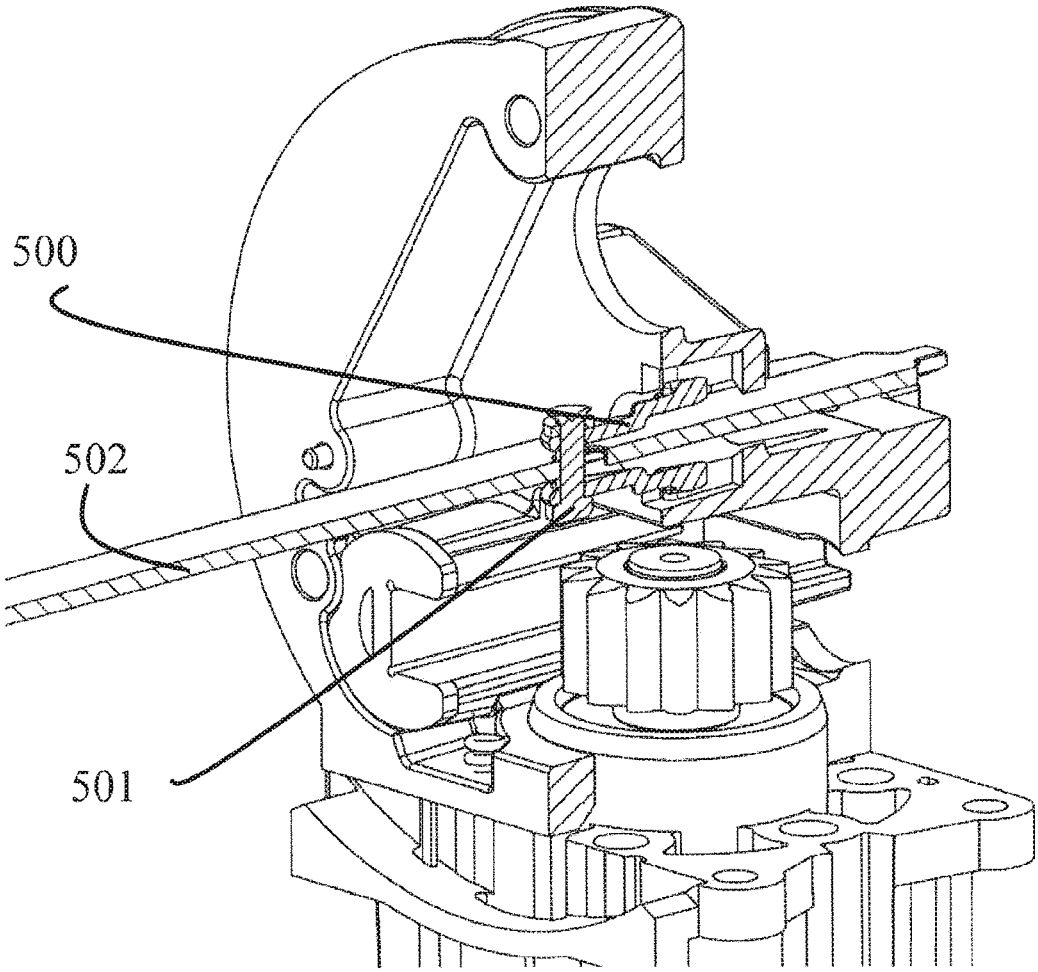
FIG. 15 illustrates a cross-sectional view of a latch mechanism used in the powered fastener driver in alternative embodiment.

Turning now to FIG. 15, which shows a latch mechanism similar to the one shown in FIGS. 3-4B. A latch 500 is provided to engage a drive blade 502 of the fastener driver. The drive blade 502 includes a notch (not shown) in which a pin 501 on the latch 500 is received to engage the drive blade 502 and maintain the drive piston in the TDC position. The latch 500 is biased by a spring (not shown) to pivot the latch 500 about a pivot pin (not shown) arranged on the drive piston. The material forming the latch 500 can be plastic or metal. Preferably, investment casting is applied to body of the latch 500 to increase its strength.

Figure 16:
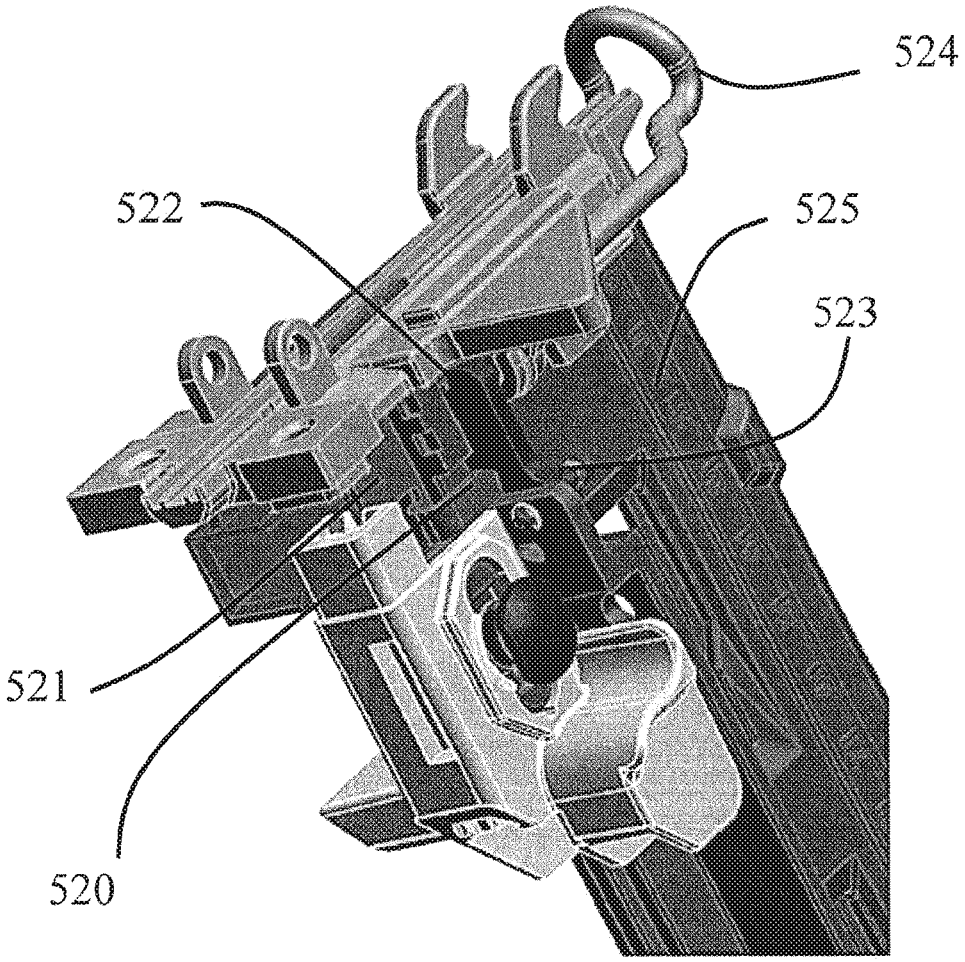
FIG. 16 shows a lock out mechanism used in the powered fastener driver according to one embodiment of the present invention.
Figure 17:
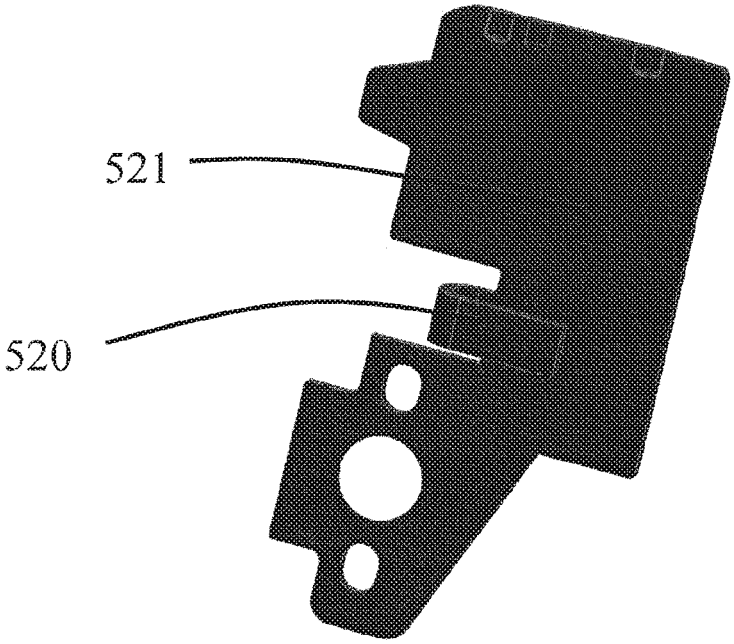
FIG. 17 shows the pusher used in the lock out mechanism in FIG. 16.
Figure 18:
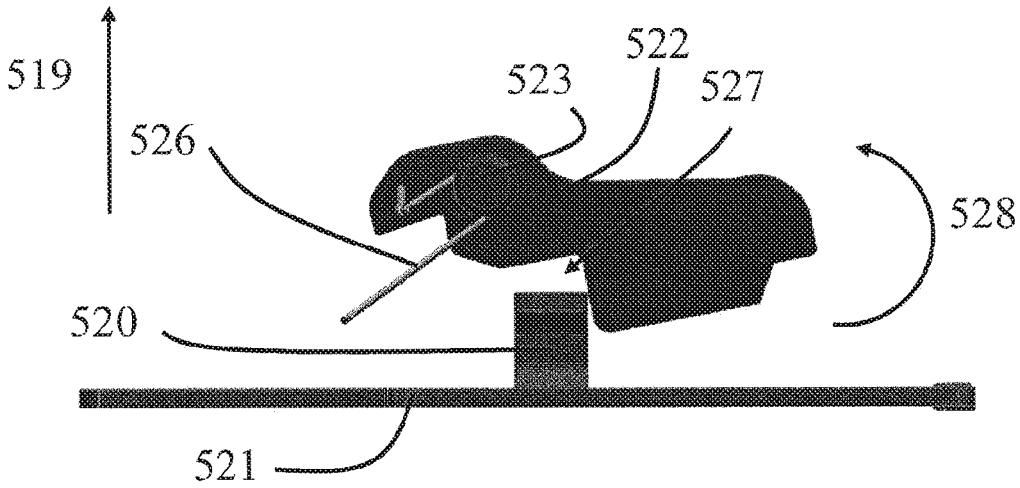
FIG. 18 illustrates the lock plate and pusher configuration in the lock out mechanism in FIG. 16.

With reference to FIGS. 16-19B, in one embodiment of the present invention the fastener driver contains a lock out mechanism. The lock out mechanism, in addition to the commonly seen contact lock mechanism that is used to lock the trigger when a contact plate is not pressed firmly against an object, provides an another safety measure by locking the contact plate and in turn the trigger when there is no remaining fasteners (e.g. nails) to be shot in the magazine. As shown in FIGS. 16-18, the lock out mechanism contains a pusher 521 in a substantially sheet shape, and a lock leg 520 protruding from surface of the pusher 521. The lock leg 520 is preferably formed in a folded "L" shape that has an end portion substantially parallel to the surface of the pusher 521. The pusher 521 is capable of moving traversely when no fastener is left in the magazine 525 anymore. As skilled person would understand, there are many ways of configuring movement of such pusher when no fastener is left in the magazine, for example by using a fastener push mechanism utilizing a spring to provide a biasing force. On the frame of the lock out mechanism there is also a pivotable lock plate 522 connected to the frame by a hinge 523. The lock plate 522 is further biased to a unlock position by a torsion spring 526. The lock plate 522 can be rotated in order to lock the contact plate 524 from being pressed, which will also be described in more details later.

Figure 19A:
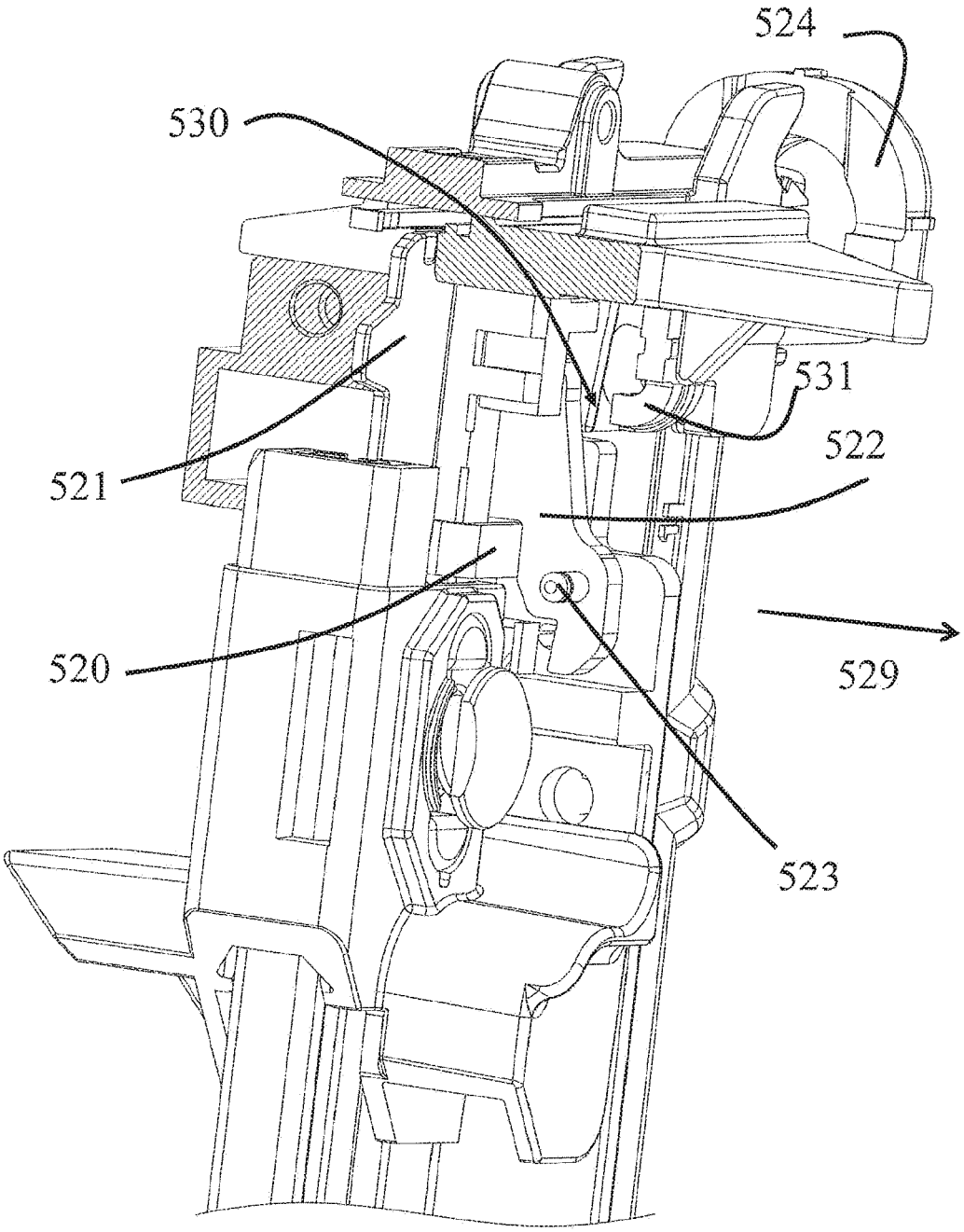
FIGS. 19A and 19B show the lock out mechanism in its unlocking position and locking position respectively.
Figure 19B:
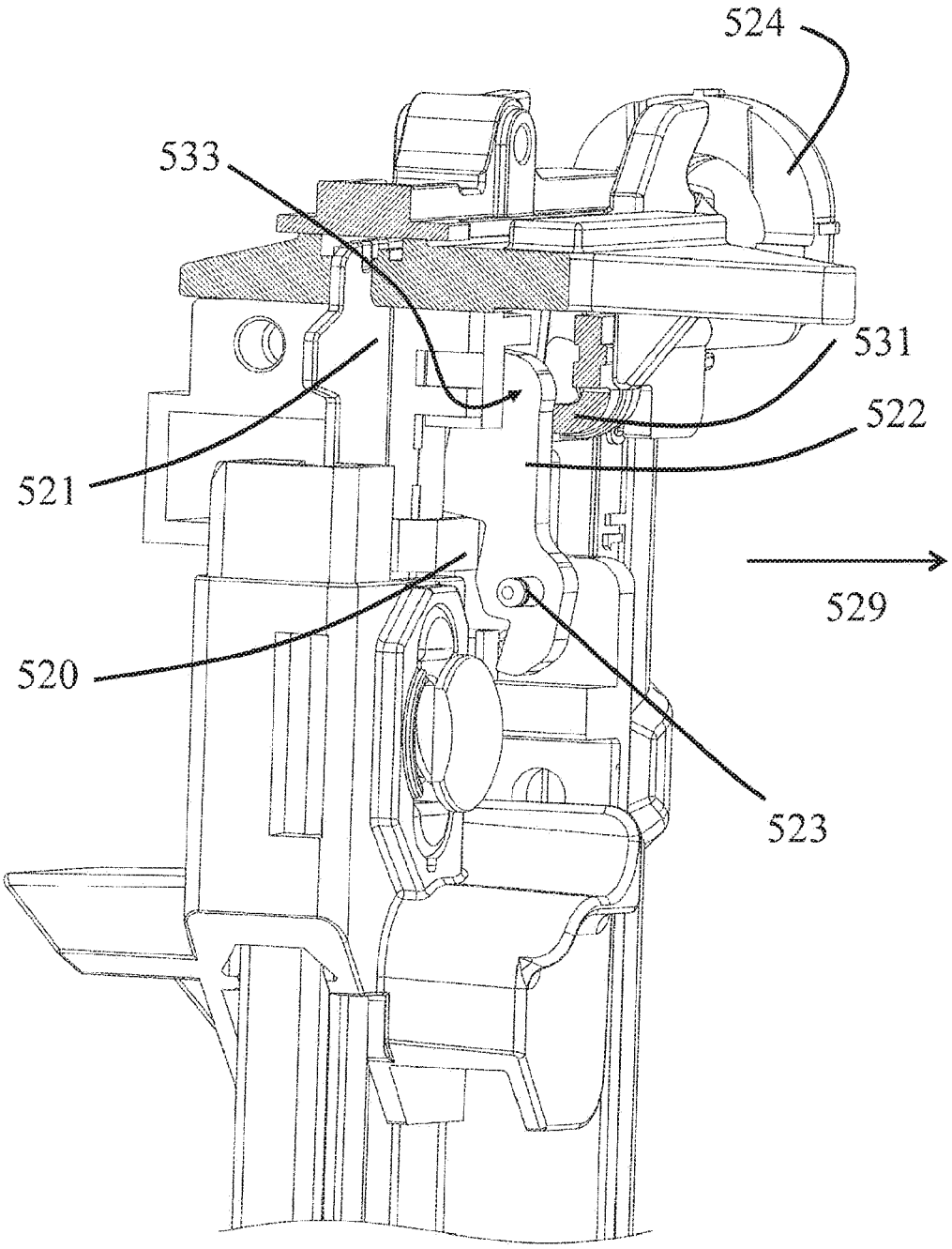
Figure 20:
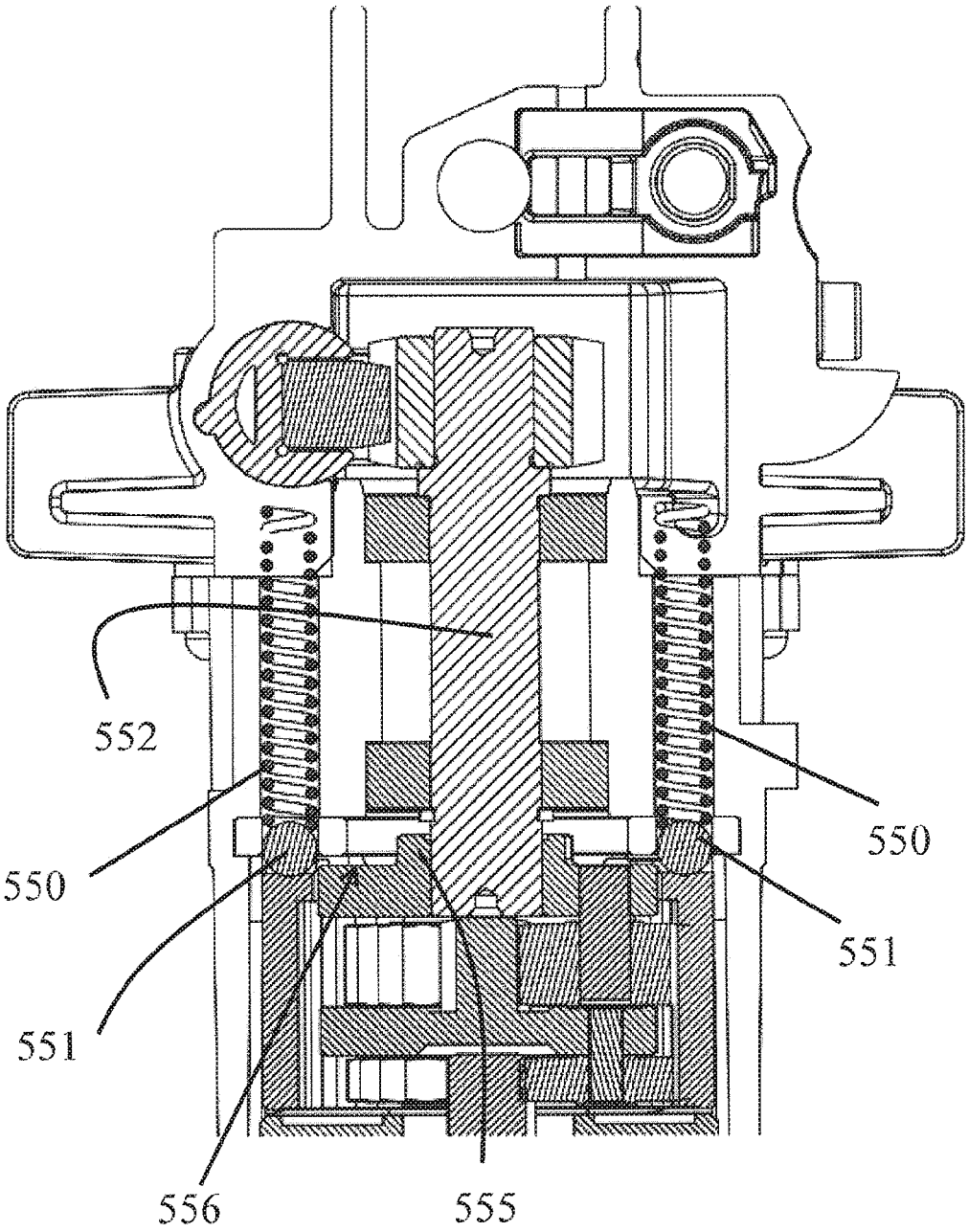
FIG. 20 illustrates the cross-sectional view of a clutch mechanism used in the powered fastener driver according to one embodiment of the present invention.

Next, FIGS. 18, 19A, and 19B illustrate the working principle of the lock out mechanism described above. FIG. 18 is a brief illustration of how the lock plate 522 is rotated by the movement of pusher 521. The pusher 521 is adapted to move along the direction shown by arrow 519 in FIG. 18. At its lower position (not shown), the lock leg 520 on the pusher 521 has not come into the cavity 527 formed in the lock plate 522. However, when the pusher 521 moves from its lower position to its higher position (not shown) along the direction shown by arrow 519, the lock leg 520 moves into the cavity 527, and further movement of the lock leg 520 urges the lock plate 522 to rotate along the direction shown by arrow 528.

The lock out mechanism used to lock the contact plate at the front end of the nailer is then described with respect to FIGS. 19A-19B. FIG. 19A shows the status of the lock out mechanism in its unlocked position, i.e. when there is still at least one fastener in the magazine (not shown). In this status the pusher 521 is in its original position where the lock leg 520 has not come into contact with the lock plate 522. As a result, there is gap formed between a rear end of the lock plate 522 and a stop member 531 fixed on a frame of the nailer. The contact plate 524 can then be pressed to pass through the gap 530 when the contact plate 524 is pressed firmly on a surface of the workpiece. However, when the last fastener in the magazine is already shot (i.e. depleted), the pusher 521 will move along the direction indicated by the arrow 529 due to a bias mechanism, for example by using a spring as mentioned above. The movement of the pusher 521 from its position in FIG. 19A to that in FIG. 19B along the direction 529, makes the lock leg 520 come into contact with the cavity of the lock plate 522 as mentioned above, and consequently urges the lock plate 522 to rotate clockwise in FIG. 19B. Such rotation of lock plate 522 makes its rear end 523 engage the stop member 531. The previous gap allowed for the contact plate 524 to pass therethrough is now closed. Even if the user presses the contact plate 524 firmly onto a surface, the contact plate 524 cannot move axially as it is stopped by the lock plate 522. Therefore, in this condition the user will not be able to press the trigger while the contact plate 524 is still locked. The lock out mechanism therefore prevents accidental actuation of the fastener driver when there is not any fastener present in the magazine of the fastener driver.

Figure 21:
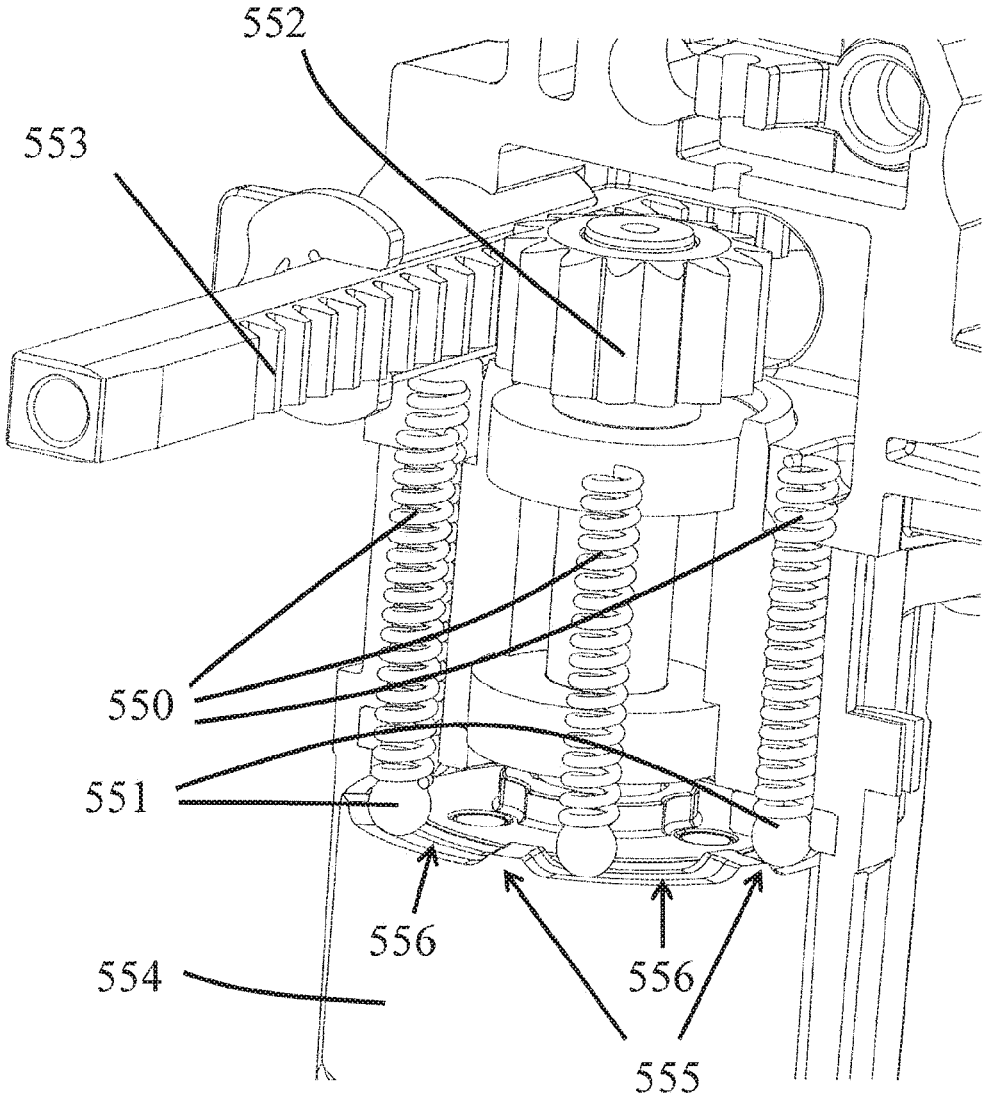
FIG. 21 shows the perspective view of the clutch mechanism in FIG. 20. Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

With reference to FIGS. 21-22, in another embodiment of the present invention the fastener driver further contains a clutch assembly used to allow free-wheeling of a ring gear by selectively engaging the ring gear and the motor. In the drawings, the illustrated clutch mechanism contains a plurality of detent balls 551, and corresponding number of springs 550 each connecting a detent ball 151 on one end and a ring gear (not shown) on another end. The ring gear mechanically connects to the pinion 552 and in turn the pinion 552 drives the rack 553 to move. The springs 550 are compressible along their longitudinal direction. The detent balls 551 are circumferentially configured on an end surface of the motor rotor 554, and on the same surface there are also circumferentially formed protrusions 555. Between every two protrusions 555 there are grooves 556 formed. The detent balls 551 are movable relative to the surface of rotor 554. In operation, when the clutch is switched to engage the ring gear with the motor rotor 554, the springs 550 are compressed to their minimum length while the detent balls 551 are located within the grooves 556 on the ring gear 554. When the motors rotor 554 rotates, the detent balls are driven by the protrusions 555 since the detent balls cannot "bypass" the protrusions 555 when the spring 550 cannot be further compressed and its length cannot be reduced anymore. However, when the clutch is switched to disengage the ring gear from the motor, the distance between the ring gear and the motor rotor 554 is increased, for example to an uncompressed length of the springs 550, therefore restoring the springs 550. As a result, when the ring gear keeps rotating due to remaining kinetic energy, the detent balls 551 cannot drive the motor in the reverse way since now the springs 550 are compressible again and any relatively movement of the detent balls 551 toward the protrusions 550 will lead the detent balls 551 to "bypass" the protrusions 550. In the process of "bypassing" the corresponding spring 550 is compressed by a length substantially equal to the height of the protrusion 550 over the groove 556. The detent ball 550 then enters another groove 556 on another side of the protrusion 550. As such, the free-wheeling of ring gear does not drive the motor in the reverse way. In the event it is desired to successively drive additional fasteners, the remaining kinetic energy is available for the subsequent operation thereby economizing battery power and saving the drive assembly elements and/or the motor from having to absorb the impact that would otherwise occur by bringing the ring gear to a full stop immediately after the power stroke.

Although the invention has been described in detail with reference to certain preferred embodiments, variations and modifications exist within the scope and spirit of one or more independent aspects of the invention as described.

What is claimed is:

1. A method of operating a powered fastener driver having a cylinder that includes opposite first and second ends, a bumper positioned within the cylinder proximate the second end, a drive piston within the cylinder having a drive blade, and a reciprocating piston within the cylinder through which the drive blade is extendable, said method comprising:

maintaining the drive piston within the cylinder at a top dead center position proximate the first end;

moving the reciprocating piston away from the drive piston and toward a bottom dead center position at a first speed while the drive piston is maintained at the top dead center position, the bottom dead center position being proximate the second end;

detecting the reciprocating piston with a monitoring system while the reciprocating piston continues to move toward the bottom dead center position and prior to the reciprocating piston reaching the bottom dead center position; and decelerating the reciprocating piston from the first speed while the reciprocating piston continues to move toward the bottom dead center position in response to being detected.

2. The method according to claim 1, further comprising releasing the drive piston from the top dead center position once the reciprocating piston reaches the bottom dead center position.

3. The method according to claim 2, further comprising moving the reciprocating piston toward the drive piston at a second speed once the drive piston has been released from the top dead center position.

4. The method according to claim 3, further comprising detecting the drive piston with the monitoring system prior to the drive piston reaching the top dead center position, and decelerating the reciprocating piston from the second speed in response to being detected.

5. The method according to claim 4, wherein detecting the drive piston with the monitoring system includes detecting a magnet positioned in the drive piston with a sensor of the monitoring system.

6. The method according to claim 4, further comprising detecting the reciprocating piston with the monitoring system prior to the reciprocating piston reaching the top dead center position, and continuing to move the reciprocating piston toward the drive piston for a predetermined period of time.

7. The method according to claim 6, wherein the predetermined period of time is adjusted according to power available in a battery powering the fastener driver.

8. The method according to claim 6, wherein continuing to move the reciprocating piston toward the drive piston for a predetermined period of time removes air trapped between the drive piston and the reciprocating piston by driving air through a valve in the reciprocating piston.

9. The method according to claim 1, wherein detecting normal operation of the powered fastener driver with the monitoring system comprises sequential steps of detecting the reciprocating piston prior to the reciprocating piston reaching the bottom dead center position, detecting the drive piston leaving the top dead center position, detecting the drive piston prior to the drive piston reaching the top dead center position, and detecting the reciprocating piston prior to the reciprocating piston reaching the top dead center position, and wherein detecting abnormal operation of the powered fastener driver with the monitoring system comprises detecting operation of the fastener driver with the monitoring system that differs from normal operation of the fastener driver, and wherein the method further comprises detecting abnormal operation with the monitoring system.

10. The method according to claim 9, further comprising moving the reciprocating piston toward the drive piston in response to detecting abnormal operation.

11. The method according to claim 10, further comprising counting the number of cycles of abnormal operation and powering off the fastener driver when the number of cycles of abnormal operation is greater than a predetermined number.

12. The method according to claim 1, wherein detecting the reciprocating piston with the monitoring system includes detecting a magnet positioned in the reciprocating piston with a sensor of the monitoring system.

13. A method of operating a powered fastener driver having a cylinder that includes opposite first and second ends, a bumper positioned within the cylinder proximate the second end, a drive piston within the cylinder having a drive blade, and a reciprocating piston within the cylinder through which the drive blade is extendable, the method comprising:

maintaining the drive piston within the cylinder at a top dead center position proximate the first end;

moving the reciprocating piston away from the drive piston and toward a bottom dead center position at a first speed while the drive piston is maintained at the top dead center position, the bottom dead center position being proximate the second end;

releasing the drive piston from the top dead center position once the reciprocating piston reaches the bottom dead center position;

moving the reciprocating piston toward the drive piston and toward the top dead center position at a second speed once the drive piston has been released from the top dead center position;

detecting the drive piston with a monitoring system while the reciprocating piston continues to move toward the top dead center position and prior to the drive piston reaching the top dead center position; and decelerating the reciprocating piston from the second speed while the reciprocating piston continues to move toward the top dead center position in response to being detected.

14. The method according to claim 13, further comprising detecting the reciprocating piston with the monitoring system prior to the reciprocating piston reaching the top dead center position, and continuing to move the reciprocating piston toward the drive piston for a predetermined period of time.

15. The method according to claim 14, wherein detecting the reciprocating piston with the monitoring system includes detecting a magnet positioned in the reciprocating piston with a sensor of the monitoring system.

16. The method according to claim 14, wherein continuing to move the reciprocating piston toward the drive piston for a predetermined period of time removes air trapped between the drive piston and the reciprocating piston by driving air through a valve in the reciprocating piston.

17. The method according to claim 13, wherein detecting the drive piston with the monitoring system includes detecting a magnet positioned in the drive piston with a sensor of the monitoring system.

18. The method according to claim 13, wherein detecting normal operation of the powered fastener driver with the monitoring system comprises sequential steps of detecting the reciprocating piston prior to the reciprocating piston reaching the bottom dead center position, detecting the drive piston leaving the top dead center position, detecting the drive piston prior to the drive piston reaching the top dead center position, and detecting the reciprocating piston prior to the reciprocating piston reaching the top dead center position, and wherein detecting abnormal operation of the powered fastener driver with the monitoring system comprises detecting operation of the fastener driver with the monitoring system that differs from normal operation of the fastener driver, and wherein the method further comprises detecting abnormal operation with the monitoring system and moving the reciprocating piston toward the drive piston in response to detecting abnormal operation.

* * * * *